US005238789A

United States Patent [19]

Ohshima

[11] Patent Number: 5,238,789

[45] Date of Patent: Aug. 24, 1993

[54] COLOR PHOTOGRAPHIC IMAGE FORMATION METHOD

[75] Inventor: Naoto Ohshima, Kanagawa, Japan

[73] Assignee: Fuji Photo Film Co., Ltd., Kanagawa, Japan

[21] Appl. No.: 803,917

[22] Filed: Dec. 9, 1991

Related U.S. Application Data

[63] Continuation of Ser. No. 418,352, Oct. 20, 1989, abandoned.

[30] Foreign Application Priority Data

Oct. 3, 1988 [JP] Japan ..... 63-249245

[51] Int. Cl.[5] ..... G03C 7/30

[52] U.S. Cl. ..... 430/372; 430/380; 430/382; 430/399; 430/467; 430/435; 430/489; 430/490; 430/567

[58] Field of Search ..... 430/382, 372, 380, 435, 430/489, 505, 399, 490, 567, 467

[56] References Cited

U.S. PATENT DOCUMENTS 4,801,516 1/1989 Ishikawa et al. ..... 430/380
4,851,326 7/1989 Ishikawa et al. ..... 430/380
4,853,321 8/1989 Momoki et al. ..... 430/380
4,880,728 11/1989 Ishikawa et al. ..... 430/380

FOREIGN PATENT DOCUMENTS 63-106655 5/1988 Japan .
106665 5/1988 Japan .

*Primary Examiner*—Janet C. Baxter
*Attorney, Agent, or Firm*—Sughrue, Mion, Zinn, Macpeak & Seas

[57] ABSTRACT

A method for forming an image, comprising developing an imagewise exposed silver halide color photographic material comprising a support having thereon at least one blue sensitive silver halide emulsion layer, at least one green-sensitive silver halide emulsion layer, and at least one red-sensitive silver halide emulsion layer with a color developer containing at least one aromatic primary amine color developing agent, wherein the red-sensitive silver halide emulsion layer contains a high silver chloride silver halide emulsion having a silver bromide content of from 0.5 to 6 mol%, and the color developer contains from $3.5\times10^{-2}$ to $1.5\times10^{-1}$ mol/l of chloride ion and from $3.0\times10^{-5}$ to $1.0\times10^{-3}$ mol/l of bromide ion. The method provides an image having a high maximum density and a low minimum density at high sensitivity while markedly suppressing variations in photographic characteristics, particularly of minimum density, even in rapid and continuous processing.

9 Claims, No Drawings

COLOR PHOTOGRAPHIC IMAGE FORMATION METHOD

This is a continuation application of U.S. Ser. No. 07/418,352 filed Oct. 20, 1989, now abandoned.

FIELD OF THE INVENTION

This invention relates to a method of image formation with a silver halide color photographic material. More particularly, it relates to a method for forming an image by using a high silver chloride photographic material having high sensitivity, less fog and excellent developability.

BACKGROUND OF THE INVENTION

In photographic processing of color photographic materials, a demand for reducing processing time has been increasing in order to cope with the recent demands for shortening the date of delivery of finished photographic materials and for reducing labor at laboratories. Reduction in processing time for each processing step has generally been achieved by increasing the processing temperature or increasing the rate of replenishment. In addition, many other approaches have been made, including enhanced stirring or use of various accelerators.

To speed up color development and/or to reduce replenishment rate, it is known to use a color photographic material containing a silver chloride emulsion in place of a silver bromide or silver iodide emulsion that has been widely employed. For example, International Publication WO 87-04534 discloses a method of rapidly developing a color photographic material containing a high silver chloride emulsion with a color developer containing substantially neither sulfite ion nor benzyl alcohol.

It has turned out, however, that when development processing according to the above-described method is carried out using an automatic developing machine, photographic characteristics, particularly minimum density, vary, sometimes resulting in serious stain of the white background.

Rapid development processing utilizing a high silver chloride color photographic material thus involves a serious problem in terms of a variation of photographic characteristics, and a solution to these problems has been keenly desired.

In rapid development using a high silver chloride color photographic material, use of an organic antifoggant to thereby reduce variation of photographic characteristics (especially fog) through continuous processing as described in JP-A-58-95345 and JP-A-59-232342 (the term "JP-A" as used herein means an "unexamined published Japanese patent application") has been proposed. Nevertheless, the fog preventing effect attained has been proved insufficient for preventing an increase of minimum density accompanying continuous processing. Moreover, such an antifoggant, when used in a large quantity, rather causes a decrease in the maximum density.

JP-A-61-70552 proposes a method for reducing the rate of developer replenishment, in which a high silver chloride color photographic material is development-processed while replenishing a development bath at such a rate that overflow does not occur. Further, JP-A-63-106655 discloses a method for assuring processing stability, in which a high silver chloride color photographic material is development-processed with a color developer containing a hydroxylamine compound and a chloride at or above a given concentration.

However, these methods were found to cause the above-described disadvantage, i.e., variation of photographic characteristics in continuous processing with an automatic developing machine, and therefore proved incompetent to solve the problem confronting us.

SUMMARY OF THE INVENTION

One object of this invention is to provide a method for rapidly processing a high silver chloride color photographic material which provides an image having a high maximum density and a low minimum density at high sensitivity while markedly inhibiting variations in the photographic characteristics (especially variation of minimum density) accompanying continuous processing.

It has now been found that the above object of this invention is accomplished by a method for forming an image which comprises developing an imagewise exposed silver halide color photographic material comprising a support having thereon at least one blue-sensitive silver halide emulsion layer, at least one green-sensitive silver halide emulsion layer, and at least one red-sensitive silver halide emulsion layer with a color developer containing at least one aromatic primary amine color developing agent, wherein the red-sensitive silver halide emulsion layer contains a high silver chloride silver halide emulsion having a silver bromide content of from 0.5 to 6 mol%, and the color developer contains from $3.5\times10^{-2}$ to $1.5\times10^{-1}$ mol of chloride ion and from $3.0\times10^{-5}$ to $1.0\times10^{-3}$ mol/l of bromide ion.

DETAILED DESCRIPTION OF THE INVENTION

Chloride ion is a well-known antifoggants but produces a small effect. Even if it is present in a large quantity, a complete prevention of an increase of fog accompanying continuous processing is a long way off but, in turn, it retards development and decreases the maximum density.

Also known as an antifoggant, bromide ion may prevent fog attendant on continuous processing to some extent when added in proper amounts, but is still insufficient. Further, it suppresses development and decreases the maximum density and sensitivity. Therefore bromide ion is unsuitable for practical use.

Despite these facts, the inventors have discovered, as a result of extensive investigations, that variations of photographic characteristics (particularly variation of minimum density) accompanying continuous processing with an automatic developing machine can be prevented without decreasing the maximum density by using a high silver chloride light-sensitive material of which the red-sensitive silver halide emulsion contains a high silver, chloride emulsion having a silver bromide content of from 0.5 to 6 mol% and developing such a material with a color developer containing from $3.5\times10^{-2}$ to $1.5\times10^{-1}$ mol/l of chloride ion and from $3.0\times10^{5}$ to $1.0\times10^{-3}$ mol/l of bromide ion.

It is utterly unpredictable and really surprising that the effects stated above are not produced by chloride ion or bromide ion alone but from a combination thereof at specific concentrations.

In the present invention, a color developer should contains chloride ion in a concentration of from $3.5\times10^{-2}$ to $1.5\times10^{-1}$ mol/l, preferably from $4\times10^{-2}$ to $1\times10^{-1}$ mol/l. A chloride ion concentration exceeding $1.5\times10^{-1}$ mol/l retards development and is far from attainment of the objects of this invention, i.e., rapid development and high maximum density. A chloride ion concentration less than $3.5\times10^{-2}$ mol/l causes great variations in photographic characteristics (particularly, variation of minimum density) in continuous processing but also an increase of residual silver, failing to achieve the objects of this invention.

Further, the color developer to be used in the present invention contains bromide ion in a concentration of from $3.0\times10^{-5}$ to $1.0\times10^{-3}$ mol preferably from $5.0\times10^{-5}$ to $5\times10^{-4}$ mol/l. If the bromide ion is higher than $1\times10^{-3}$ mol , development is retarded, and the maximum density and sensitivity are reduced. If it is less than $3.0\times10^{-5}$ mol , variation in the photographic characteristics (particularly variation of minimum density) in continuous processing cannot be prevented, failing to achieve the objects of this invention.

Chloride and bromide ions may be directly added to a developer or may be supplied from the light-sensitive material through elution during development.

In the former case, substances supplying chloride ion include sodium chloride, potassium chloride, ammonium chloride, nickel chloride, magnesium chloride, manganese chloride, calcium chloride, and cadmium chloride, with sodium chloride and potassium chloride being preferred. Substances supplying bromide ion include sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide being preferred. Chloride or bromide ion may be supplied in the form of a salt of a fluorescent whitening agent which is added to the developer.

In the latter case, both chloride and bromide ions may be supplied from emulsions or in other forms. JP-A-63-106655 discloses a method of processing a silver chloride light-sensitive material having a silver chloride content of 70 mol% or more with a developer containing $2\times10^{-2}$ mol or more of a chloride. However, the bromide concentration in the developer is out of the scope of the present invention. The disclosure does not at all refer to specific effects obtained by a combination of proper amounts of bromide and chloride ions according to the present invention much less the problems the present invention aims to solve.

The effect of inhibiting variations in photographic characteristics accompanying continuous processing cannot be fully explained simply from the fact that the high development activity due to the use of a high silver chloride emulsion and reduced activity due to the presence of adequate amounts of bromide and chloride ions are well balanced.

From the viewpoint of stable processing during continuous processing and prevention of streaky pressure marks, it is preferable that the color developer contains substantially no sulfite ion. In order to inhibit deterioration of the developer without using a sulfite preservative, it is recommended that the developer should not be used for a long time; physical means are taken to reduce the influence of air, such as use of a floating lid and reduction of the opening of a development tank; the temperature of the developer is controlled; and chemical means, such as addition of an organic preservative, are employed. Addition of an organic preservative is advantageous as a matter of convenience.

Suitable organic preservatives include organic compounds which, when added to a color developer, function to suppress deterioration of an aromatic primary amine color developing agent due to, for example, air-oxidation. Particularly effective organic preservatives include hydroxylamine derivatives (exclusive of hydroxylamine, hereinafter the same), hydroxamic acids, hydrazines, hydrazides, phenols, α-hydroxyketones, α-aminoketones, saccharides, monoamines, diamines, polyamines, quaternary ammonium salts, nitroxyl radicals, alcohols, oximes, diamide compounds, and condensed ring amines as described in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, Japanese Patent Application No. 61-170756, JP-A-61-170756, JP-A-63-44657, JP-A-63-44656, U.S. Pat. Nos. 3,615,503 and 2,494,903, JP-A-52-143020, and JP-B-48-30496.

Preferred organic preservatives are described in detail hereinafter. These compounds described below are usually added to a color developer in a concentration of from 0.005 to 0.5 mol/l, preferably from 0.03 to 0.1 mol/l.

Addition of hydroxylamine derivatives and/or hydrazine derivatives is particularly desirable.

Hydroxylamine derivatives preferably include those represented by formula (IV):

(IV)

Wherein $R^{51}$ and $R^{52}$, which may be the same or different, each represents a hydrogen atom, a substituted or unsubstituted alkyl group, a substituted or unsubstituted alkenyl group, a substituted or unsubstituted aryl group, or a heterocyclic aromatic group, or $R^{51}$ and $R^{52}$ can combine to form a 5- or 6-membered heterocyclic ring together with the nitrogen atom, provided that $R^{51}$ and $R^{52}$ do not simultaneously represent a hydrogen atom.

In formula (IV), $R^{51}$ and $R^{52}$ each preferably represents an alkyl or alkenyl group having from 1 to 10, and particularly from 1 to 5, carbon atoms. Preferred substituents for $R^{51}$ and $R^{52}$ include hydroxyl, alkoxyl, alkylsulfonyl, arylsulfonyl, amide, carboxyl, cyano, sulfo, nitro, and amino groups. The heterocyclic ring formed by $R^{51}$-N-$R^{52}$ may be saturated or unsaturated and comprises a carbon atom, a hydrogen atom, a halogen atom, an oxygen atom, a nitrogen atom, a sulfur atom, etc. Such a heterocyclic ring includes piperidyl, pyrrolidinyl, N-alkylpiperazyl, morpholyl, indolinyl, and benzotriazole rings.

Specific examples of the hydroxylamine derivatives of formula (IV) are shown below.

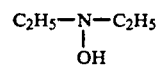

IV-1

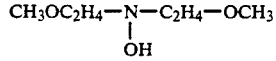

IV-2

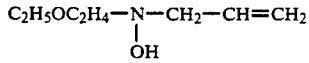

IV-3

-continued

IV-4

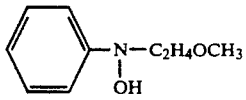

IV-5

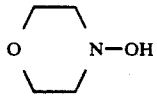

IV-6

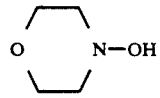

IV-7

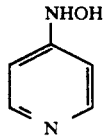

IV-8

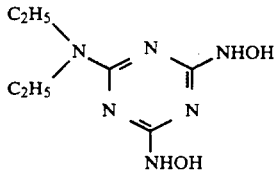

The hydrazines and hydrazides preferably include those represented by formula (V):

(V)

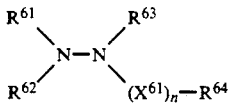

wherein $R^{61}$, $R^{62}$, and $R^{63}$, which may be the same or different, each represents a hydrogen atom, a substituted or unsubstituted alkyl group, a substituted or unsubstituted aryl group, or a substituted or unsubstituted heterocyclic group; $R^{64}$ represents a hydroxyl group, a hydroxylamino group, a substituted or unsubstituted alkyl group, a substituted or unsubstituted aryl group, a substituted or unsubstituted, saturated or unsaturated 5- or 6-membered heterocyclic group comprising of a carbon atom, a hydrogen atom, an oxygen atom, a nitrogen atom, a sulfur atom, a halogen atom, etc., a substituted or unsubstituted alkoxyl group, a substituted or unsubstituted aryloxy group, a substituted or unsubstituted carbamoyl group, or a substituted or unsubstituted amino group; $X^{61}$ represents a divalent group selected from —CO—, —$SO_2$— and $$-\overset{\overset{\displaystyle NH}{\|}}{C}-;$$

and n represents 0 or 1; provided that when n is 0, $R^{64}$ is selected from an alkyl group, an aryl group, and a heterocyclic group; $R^{63}$ and $R^{64}$ may combine to form a heterocyclic group.

In formula (V), $R^{61}$, $R^{62}$, and $R^{63}$ each preferably represents a hydrogen atom or an alkyl group having from 1 to 10 carbon atoms. $R^{61}$ and $R^{62}$ each more preferably represents a hydrogen atom.

$R^{64}$ preferably represents an alkyl group, an aryl group, an alkoxyl group, a carbamoyl group, or an amino group, and more preferably an alkyl group or a substituted alkyl group. Preferred substituents for the alkyl group include a carboxyl group, a sulfo group, a nitro group, an amino group, a phosphono group, etc. $X^{61}$ preferably represents —CO— or $SO_2$—, more preferably —CO—.

Specific examples of the hydrazines and hydrazides represented by formula (V) are shown below.

V-1

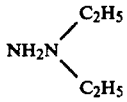

V-2 $NH_2NH(CH_2)_4SO_3H$

V-3 $NH_2NH(CH_2)_2SO_3H$

V-4

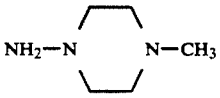

V-5

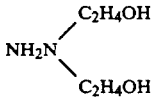

V-6 $NH_2NHCOCH_3$

V-7 $NH_2NHCOOC_2H_5$

V-8

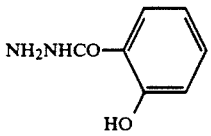

V-9

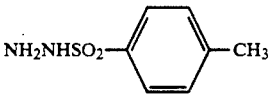

V-10 $NH_2NHCONH_2$

V-11

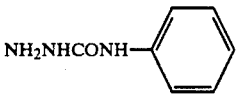

V-12 $NH_2NHSO_3H$

V-13 $NH_2NHC(=NH)NH_2$

V-14 $NH_2NHCOCONHNH_2$

V-15 $NH_2NHCH_2CH_2CH_2SO_3H$

V-16

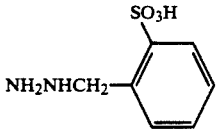

V-17 $NH_2NHCH(C_4H_9(n))COOH$

V-18 $NH_2NHCH_2CH_2COOH$

-continued

V-19

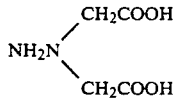

V-20

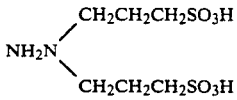

V-21

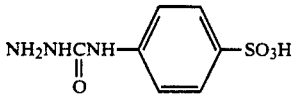

V-22

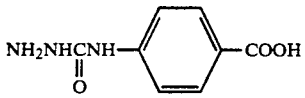

To improve stability of a color developer and ultimately assure stable continuous processing, it is preferred to use a compound represented by formula (IV) or (V) in combination with an amine represented by formula (VI) or (VII):

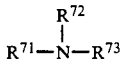

(VI)

wherein $R^{71}$, $R^{72}$, and $R^{73}$ each represents a hydrogen atom, a substituted or unsubstituted alkyl group, a substituted or unsubstituted alkenyl group, a substituted or unsubstituted aryl group, a substituted or unsubstituted aralkyl group, or a substituted or unsubstituted heterocyclic group; or $R^{71}$ and $R^{72}$, $R^{71}$ and $R^{73}$ or $R^{72}$ and $R^{73}$ may combine to form a nitrogen-containing heterocyclic ring.

In formula (VI), $R^{71}$, $R^{72}$, and $R^{73}$ each preferably represents a hydrogen atom or an alkyl group. Examples of substituents for $R^{71}$, $R^{72}$, or $R^{73}$ include a hydroxyl group, a sulfo group, a carboxyl group, a halogen atom, a nitro group, an amino group, etc.

Specific examples of the amine compounds represented by formula (VI) are shown below.

VI-1 $N(CH_2CH_2OH)_3$

VI-2 $H_2NCH_2CH_2OH$

VI-3 $HN(CH_2CH_2OH)_2$

VI-4

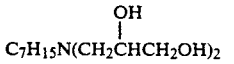

VI-5

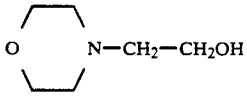

VI-6

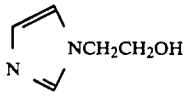

VI-7

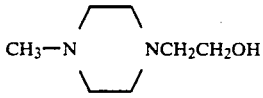

-continued

VI-8

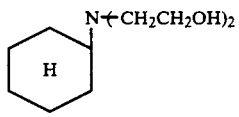

VI-9

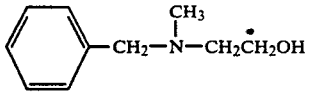

VI-10 $(HOCH_2CH_2)_2NCH_2CH_2SO_2CH_3$

VI-11 $HN(CH_2COOH)_2$

VI-12

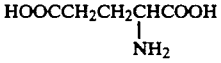

VI-13 $H_2NCH_2CH_2SO_2NH_2$

VI-14

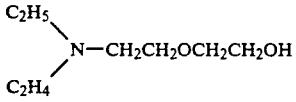

VI-15 $H_2N—C(CH_2OH)_2$

VI-16

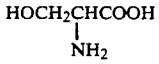

VI-17

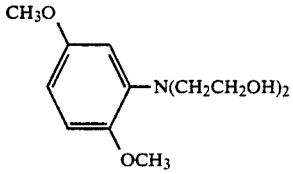

VI-18

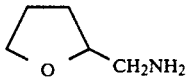

VI-19

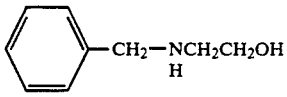

VI-20

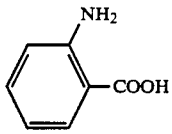

(VII)

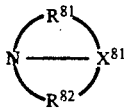

wherein $X_{81}$ represents a trivalent atomic group necessary to complete a condensed ring; and $R^{81}$ and $R^{82}$, which may be the same or different, each represents an alkylene group, an arylene group, an alkenylene group, or an aralkylene group.

Of the compounds represented by formula (VII), preferred are those represented by formulae (VII-a) and (VII-b):

(VII-a)

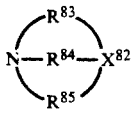

wherein $X^{82}$ represents

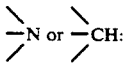

$R^{83}$ and $R^{84}$ are as defined in formula (VII) for $R^{81}$ and $R^{82}$; and $R^{85}$ represents $R^{83}$, $R^{84}$, or

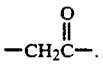

In formula (VII-a), $X^{82}$ preferably represents

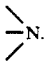

$R^{83}$, $R^{84}$, and $R^{85}$ each preferably contains not more than 6 carbon atoms, more preferably not more than 3, most preferably 2. $R^{83}$, $R^{84}$, and $R^{85}$ each preferably represents an alkylene group or an arylene group, more preferably an alkylene group (VII-b)

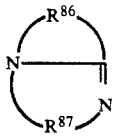

wherein $R^{86}$ and $R^{87}$ are as defined for $R^{81}$ and $R^{82}$ in formula (VII).

In formula (VII-b), $R^{86}$ and $R^{87}$ each preferably contains not more than 6 carbon atoms. $R^{86}$ and $R^{87}$ each preferably represents an alkylene group or an arylene group, more preferably an alkylene group.

Of the compounds represented by formulae (VII-a) and (VII-b), those of formula (VII-a) are preferred.

Specific examples of the compounds represented by formula (VII) are shown below.

VII-1

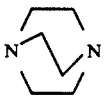

VII-2

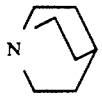

-continued

VII-3

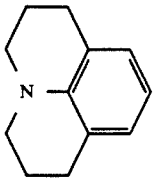

VII-4

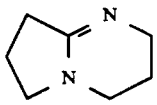

VII-5

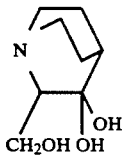

VII-6

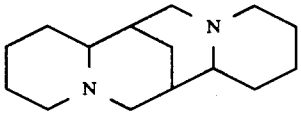

VII-7

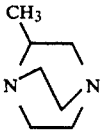

VII-8

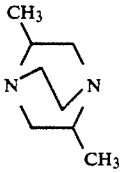

VII-9

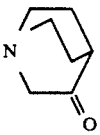

VII-10

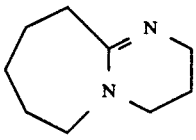

VII-11

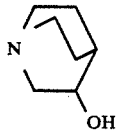

VII-12

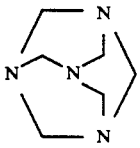

-continued

VII-13

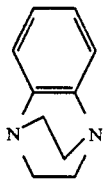

VII-14

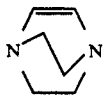

VII-15

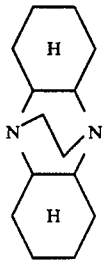

VII-16

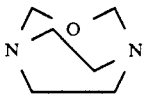

VII-17

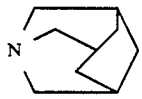

VII-18

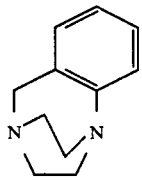

The above-described organic preservatives are commercially available or can be synthesized according to the method described in JP-A-63-170642 and JP-A-63-239447.

The color developer which can be used in the present invention contains a known aromatic primary amine color developing agent, preferably a p-phenylenediamine developing agent. Typical examples of p-phenylenediamine developing agents are shown below for illustrative purposes only.

D-1: N,N-Diethyl-p-phenylenediamine

D-2: 4-[N-Ethyl-N-(β-hydroxyethyl)amino]aniline

D-3: 2-Methyl-4-[N-ethyl-N-[β-hydroxyethyl-)amino]aniline

D-4: 4-Amino-3-methyl-N-ethyl-N-(-β-methanesulfonamidoethyl)aniline

These p-phenylenediamine derivatives may be in the form of a salt, such as a sulfate, a hydrochloride, and a p-toluenesulfonate salt.

The aromatic primary amine developing agent is used at a concentration of from about 0.1 to 20 g per liter, preferably from about 0.5 to 10 g per liter.

The pH of the color developer is preferably between 9 and 12, more preferably between 9 and 11.0.

The color developer can contain other known components. For example, various buffering agents are preferably added for controlling the pH within the above-recited range. Examples of buffering agents include sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agent is preferably used in a concentration of at least 0.1 mol/l, more preferably from 0.1 to 0.4 mol/l.

In addition, various chelating agents can be added to a color developer to prevent precipitation of calcium or magnesium or to improve the stability of the color developer. Specific examples of chelating agents which can be used are nitrilotriacetic acid, diethylenetriaminepentaacetic acid, ethylenediaminetetraacetic acid, triethylenetetraminehexa-acetic acid, N,N,N-trimethylenephosphonic acid, ethylenediamine-N,N,N', N'-tetramethylenephosphonic acid, 1,3-diamino-2-propanoltetraacetic acid, trans-cyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamineorthohydroxyphenylacetic acid, 2-n-butane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

If desired, these chelating agents may be used as a combination of two or more thereof.

These chelating agents are used in amounts sufficint to sequester metallic ions in a color developer, for example, from about 0.1 to 10 g per liter.

If desired, the color developer may contain an an appropriate development accelerator. Examples of development accelerators include the thioether compounds as described in JP-B-37-16088, JP-B-37-5987, JP-B-38-7826, JP-B-44-12380, JP-B 45 9019, and U.S. Pat. No. 3,813,247; the p-phenylenediamine compounds as described in JP-A-52-49829 and JP-A-50-15554; the quaternary ammonium salts as described in JP-A-50-137726, JP-B-44-30074, JP-A-56-156826, and JP-A-52-43429; the p-aminophenols as described in U.S. Pat. Nos. 2,610,122 and 4,119,462; the amine compounds as described in U.S. Pat. Nos. 2,494,903, 3,128,182, 4,230,796, and 3,253,919, JP-B-41-11431, and U.S. Pat. Nos. 2,482,546, 2,596,926, and 3,582,346: the polyalkylene oxides as described in JP-B-37-16088, JP-B-42-25201, U.S. Pat. Nos. 3,128,183, JP-B-41-11431, JP-B-42-23883, and U.S. Pat. No. 3,532,501; and the 1-phenyl-3-pyrazolidones, hydrazines, meso-ionic compounds, ionic compounds, imidazoles, and so on.

To minimize variations in photographic characteristics in continuous processing it is preferred for the color developer to contain substantially no benzyl alcohol. The term "substantially no benzyl alcohol" means that the developer contains not more than 2.0 ml/l of benzyl alcohol. More preferably, the color developer does not contain any benzyl alcohol at all.

If desired, the color developer may further contain other antifoggants in addition to chloride and bromide ions, such as alkali metal halides, e.g., potassium iodide, and organic antifoggants. Typical examples of suitable organic antifoggants include nitrogen-containing heterocyclic compounds, e.g., benzotriazole, 6-nitrobenzimidazole, 5-nitroisoindazole, 5-methyl-benzotriazole, 5-nitrobenzotriazole, 5-chlorobenzotriazole, 2-thiazolylbenzimidazole, 2-thiazolylmethylbenzimidazole, imidazole, hydroxyazaindolizine, and adenine.

The color developer preferably contains a fluorescent whitening agent, e.g., 4,4'-diamino-2,2'-disulfostilbene compounds. The fluorescent whitening agent is usually added in a concentration of up to 10 g/l, preferably from 0.1 to 6 g/l.

If desired, the color developer may additionally contain various surface active agents, e.g., alkylsulfonic acids, arylphosphonic acids, aliphatic carboxylic acids, and aromatic carboxylic acids.

Color development with the color developer is usually carried out at a temperature ranging from 20° to 50° C., preferably from 30° to 40° C., for a period of from 20 seconds to 5 minutes, preferably from 30 seconds to 2 minutes.

In color development, the developer is usually replenished. The rate of replenishment usually ranges from 180 to 1000 ml per $m^2$ of light-sensitive material, although this depends on the kind of the light-sensitive material to be processed. Replenishment is a means for maintaining the color developer composition constant during continuous processing of a large volume of light-sensitive materials, for example, in an automatic developing machine to thereby avoid a variation of the photographic characteristics due to change of density. Since replenishment is necessarily accompanied by a large quantity of overflow, the rate of replenishment is preferably minimized from economical and environmental considerations. A preferred rate of replenishment is from 20 ml/$m^2$ to 150 ml/$m^2$. Although this is dependent on the kind of light-sensitive material, the replenishment rate of 20 ml/$m^2$ is such a level that the amount of a processing solution which is carried over together with the light-sensitive material under processing and the amount of a replenisher supplied are substantially equal. The effects of the present invention can be achieved even at such a low rate of replenishment.

The color development is followed by desilvering. Desilvering generally comprises bleaching and fixation, either separately or simultaneously, preferably simultaneously.

The bleaching solution or bleach-fix solution can contain a re-halogenating agent, such as a bromide (e.g., potassium bromide, sodium bromide, and ammonium bromide), a chloride (e.g., potassium chloride, sodium chloride, and ammonium chloride), and an iodide (e.g., ammonium iodide). If desired, the bleaching or bleach-fix solution can further contain one or more organic or inorganic acids and alkali metal or ammonium salts thereof having a pH buffering ability (e.g., boric acid, borax, sodium metaborate, acetic acid, sodium acetate, sodium carbonate, potassium carbonate, sulfurous acid, phosphoric acid, sodium phosphate, citric acid, sodium citrate, and tartaric acid) or a corrosion inhibitor (e.g., ammonium nitrate and guanidine).

The bleach-fix solution or a fixing solution contains one or more known fixing agents, i.e., water-soluble silver halide solvents, such as thiosulfates (e.g., sodium thiosulfate and ammonium thio-sulfate), thiocyanates (e.g., sodium thiocyanate and ammonium thiocyanate), thioether compounds (e.g., ethylene bisthioglycolic acid and 3,6 dithia-1,8-octanediol), and thioureas. A special bleach-fix solution containing a fixing agent in combination with a large quantity of a halogenating agent, e.g., potassium iodide, as disclosed in JP-A-55-155354 can also be used. In the present invention, thiosulfates, particularly ammonium thiosulfate, are preferred as a fixing agent.

The fixing agent is used in a concentration of from 0.3 to 2 mol/l, preferably from 0.5 to 1.0 mol/l.

The bleach-fix or fixing solution preferably has a pH ranging from 3 to 10, more preferably from 5 to 9. If the pH is lower than 3, desilvering performance is improved, but deterioration of the processing solution is accelerated and the cyan dye tends to be rendered colorless. If the pH is higher than 10, desilvering is retarded, and stains tend to appear.

If desired, the bleach-fix or fixing solution can contain hydrochloric acid, sulfuric acid, nitric acid, acetic acid, bicarborate, ammonia, caustic potash, caustic soda, sodium carbonate, potassium carbonate, etc., to adjust the pH.

The bleach-fix solution can further contain various fluorescent whitening agents, defoaming agents, surface active agents, and organic solvents, e.g., polyvinylpyrrolidone and methanol.

The bleach-fix or fixing solution contains, as a preservative, a sulfite ion-releasing compound, such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). These sulfite ion-releasing compounds are preferably added in concentrations of from about 0.02 to 0.50 mol/l, more preferably from 0.04 to 0.40 mol/l, on a sulfite ion conversion.

While sulfites are generally added as preservatives, other preservatives, such as ascorbic acid, carbonyl bisulfite adducts, sulfinic acids, or carbonyl compounds, may also be used.

If desired, the bleach-fix or fixing solution may additionally contain buffering agents, chelating agents, antifungal agents, etc.

After desilvering, i.e., fixation or bleach-fix, the silver halide color photographic material is usually subjected to washing and/or stabilization.

The amount of water to be used in the washing can vary widely depending on the characteristics of the light-sensitive material which depends, for example, on the materials used therein, e.g., couplers; the end use of the light-sensitive material; the temperature of water; the number of washing tanks (i.e., the number of the washing stages); the replenishment system (whether a direct flow system or a counter flow system); and other conditions. Specifically, the relationship between the number of washing tanks and the amount of water can be obtained by the method described in *Journal of the Society of Motion Picture and Television Engineers*, Vol. 64, pp. 248–253 (May, 1955).

According to the multi-stage counter-flow washing system described in the above-cited reference, although the requisite quantity of water can be greatly reduced, a problem arises in that increased retention time of water in a washing tank causes proliferation of bacteria, finally resulting in deposition of floc onto the light-sensitive material.

In order to cope with this problem, any of the known techniques described in JP-A-61-1343, JP-A-60-220345, JP-A-60-238832, JP-A-60-239784, JP-A-60-239749, JP-A-61-4054, and JP-A-61-118749, can be used. In particular, a stabilizing solution containing 1-hydroxyethylidene-1,1-diphosphonic acid, 5-chloro-2-methyl-4-isothiazolin-3-one, a bismuth compound, an ammonium compound, etc. is preferably employed.

In some cases, the above-described washing step may be followed by stabilization. Such a case is exemplified by a final bath for processing color light-sensitive materials for photographing, where the bath contains formaldehyde and a surface active agent.

The processing time is the time required from contact of the light-sensitive material with the color developer to removal from the final bath (generally a washing or stabilizing bath). The effects of the present invention are significantly achieved in rapid processing completed within 4 minutes and 30 seconds, preferably within 4 minutes, as the above-defined processing time.

The color photographic material according to the present invention can be prepared by coating at least one blue-sensitive silver halide emulsion layer, at least one green-sensitive silver halide emulsion layer, and at least one red-sensitive silver halide emulsion layer on a support. General color papers usually comprise a support having provided thereon the emulsion layers in the order listed above, but different orders may also be employed. Color reproduction can be achieved by the subtractive color process in which each of the light-sensitive emulsion layers contains a silver halide emulsion with sensitivity in the respective wavelength regions and a so-called color coupler forming a dye complementary to the light to which the layer is sensitive, that is, a yellow dye complementary to blue, a magenta dye complementary to green, or a cyan dye complementary to red. In some cases, the light-sensitive layer and the hue developed by the coupler may not have such a relationship.

In the present invention, the red-sensitive silver halide emulsion layer must contain a high silver chloride emulsion having a silver bromide content of from 0.5 to 6 mol%. The terminology "high silver chloride" as used herein means silver iodochlorobromide or silver chlorobromide grains comprising essentially silver chloride and more specifically silver iodochlorobromide or silver chlorobromide containing substantially no silver iodide and preferably having a silver bromide content of 0.5 to 2 mol% If the silver bromide content is less than 0.5 mol%, the light-sensitive material tends to undergo a reduction in sensitivity or a variation in the photographic properties in continuous processing. If it exceeds 6 mol%, not only a high maximum density cannot be obtained, but reduction in sensitivity and variation of photographic characteristics tend to be accelerated.

From the viewpoint of stability in continuous processing and reduced dependence on the processing conditions, it is preferably that each of the blue-sensitive silver halide emulsion and the green-sensitive silver halide emulsion has a lower silver bromide content than in the silver halide emulsion of the red-sensitive silver halide emulsion layer. The silver halide emulsion of each the blue- and green-sensitive silver halide emulsion layers preferably contains silver chlorobromide or pure silver chloride having a silver chloride content of at least 94 mol%, more preferably at least 98 mol%.

The silver halide emulsion to be used in the red-sensitive silver halide emulsion layer preferably contains high silver chloride containing substantially no silver iodide. The term "substantially no silver iodide" means that the silver iodide content is not more than 1 mol%, preferably not more than 0.2 mol%.

The individual silver halide grains may have either a different or the same halogen composition. Use of an emulsion containing grains having the same halogen composition makes it easy to maintain the properties of the individual grains even. The grains may be homogeneous grains having a uniform halogen composition throughout the individual grains, may be the so-called core/shell type grains in which the inner core and a single or plural layers surrounding the core have different halogen compositions, or may be grains having a non-layered portion differing in halogen composition in the inside or on the surface thereof (such a portion of different halogen composition, being on the surface of the grain, is fused to the edge, corner or plane of the grain). To obtain high sensitivity, the latter two types of heterogeneous grains are preferred to homogeneous grains, which are also advantageous from the viewpoint of pressure-resistance. In the latter two cases, the boundary between the portions having different halogen compositions may be a definite boundary or a diffuse boundary forming a mixed crystal depending on the difference in composition. Further, the halogen composition may be intentionally varied in a continuous manner.

In the above-described high silver chloride emulsion, it is preferable that a locallized silver bromide phase be present in the inside and/or on the surface of grains either in a layered or in a non-layered structure. Such a local phase preferably has a silver bromide content of at least 10 mol%, more preferably more than 20 mol%. These local phases may be present in the inside of the grains or at edges or corners or on the planes of the grains. One preferred embodiment of such heterogeneous grains is those having local phases at the corners of the grains produced by epitaxy.

On the other hand, for the purpose of minimizing reduction in sensitivity due to pressure, it is also preferred to use homogeneous grains having a narrow halogen composition distribution throughout the individual grains in a high silver chloride emulsion, with the silver bromide content being 6 mol% or less.

The mean grain size (the number average of the grain size expressed in terms of a diameter of a circle having an equivalent area as the projected area of a grain) of silver halide grains contained in the silver halide emulsion is preferably from 0.1 to 2 $\mu$m.

The silver halide emulsion is preferably a so-called monodispersion having a coefficient of variation of grain size of not more than 20%, more preferably not more than 15%, the coefficient of variation being a quotient obtained by dividing the standard deviation of the grain size by the mean grain size. For the purpose of attaining broad latitude to exposure, it is preferable to use two or more monodispersed emulsions in the same layer or to coat two or more monodispersed emulsions in different layers.

The silver halide grains in the photographic emulsions may have a regular crystal form, such as a cubic form, a tetradecahedral form, and an octahedral form; or an irregular crystal form, such as a spherical form and a plate (tabular) form; or a composite form thereof. The emulsion may be composed of grains of various crystal forms. In the present invention, emulsions which are preferred are those containing not less than 50%, more preferably not less than 70%, most preferably not less than 90%, of regular crystals.

In addition, emulsions containing tabular grains having an average aspect ratio (circle-equivalent diameter/-thickness ratio) of 5 or more, preferably 8 or more, in a proportion exceeding 50% of the projected area of the total grain can also be used advantageously.

The total silver coverage of the light-sensitive material used in this invention is preferably not more than 0.80 g/m$^2$, more preferably not more than 0.75 g/m$^2$. If the total silver coverage exceeds 0.80 g/m$^2$, rapid development is impaired, and variations in photographic characteristics in continuous processing become great. The minimum amount of the total silver coverage is preferably 0.20 g/m$^2$.

The silver chlorobromide emulsions to be used in the present invention can be prepared by known techniques as described in P. Glafkides, *Chemie et Phisique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964). In more detail, any of the acid process, the neutral process, the ammonia process, and the like can be used. The reaction between a soluble silver salt and a soluble halogen salt can be carried out by any of a single jet process, a double jet process, and a combination thereof. A so called reverse mixing process in which grains are formed in the presence of excess silver ions can also be utilized. A so-called controlled double jet process, in which the pAg value of the liquid phase where silver halide grains are formed is maintained constant, can also be used. Using the controlled double jet process, a silver halide emulsion having a regular crystal form and a nearly uniform grain size distribution can be obtained.

During the grain formation or physical ripening subsequent thereto, various polyvalent metal ions can be introduced into the system as impurities. Polyvalent metal compounds which can be used include salts of cadmium, zinc, lead, copper or thallium; and salts or complexes of the Group VIII metals, e.g., iron, ruthenium, rhodium, palladium, osmium, iridium, and platinum. The compounds of the Group VIII metals are particularly preferred. The amounts of these compounds to be added are preferably from $10^{-9}$ to $10^{-2}$ mol per mol of silver halide, although the amount can vary widely depending on the purpose of addition.

The silver halide emulsions to be used in this invention are generally subjected to chemical sensitization and spectral sensitization.

Chemical sensitization can be effected by sulfur sensitization using instable sulfur compounds, noble metal sensitization typically including gold sensitization, reduction sensitization, or a combination thereof. Compounds to be used in chemical sensitization preferably include those described in JP-A-62-215272, p. 18, right lower column to p. 22, right upper column.

Spectral sensitization is conducted to endow an emulsion in each layer of the light-sensitive material with spectral sensitivity in a desired light wavelength range. In the present invention, spectral sensitization is preferably carried out by addition of a dye which absorbs light in the wavelength region corresponding to the desired spectral sensitivity, i.e., a spectral sensitizing dye. Examples of suitable spectral sensitizing dyes are described, e.g., in F. H. Harmer, *Heterocyclic Compounds-Cyanine Dyes and Related Compounds*, John Wiley & Sons, New York, London (1964). Specific examples of these dyes preferably include those described in the above-cited JP-A-62-215272, p. 22, right upper column to p. 38.

For the purpose of preventing fog during preparation, storage or photographic processing of light-sensitive materials or stabilizing photographic performance properties, the photographic emulsions to be used in the present invention can contain various kinds of compounds or precursors thereof.

Specific examples of these stabilizers which can be used preferably are described in JP-A-62-215272, pp. 39–72.

The emulsions to be used in the present invention may be either of the so-called surface latent image type which forms a latent image predominantly on the surface of the grains or of the so-called internal latent image type which forms a latent image predominantly in the inside of the grains.

Color light-sensitive materials generally contain yellow couplers, magenta couplers, and cyan couplers which form a yellow dye, a magenta dye, and a cyan dye, respectively, upon coupling with an oxidation product of an aromatic amine color developing agent.

Yellow couplers preferably used in the present invention include acylacetamide derivatives, such as benzoylacetanilide and pivaloylacetanilide. Preferred couplers are those represented by formulae (Y-1) and (Y-2):

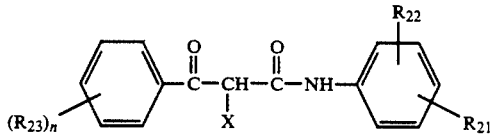

(Y-1)

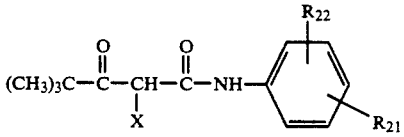

(Y-2)

wherein $X_{21}$ represents a hydrogen atom or a group releasable on coupling; $R_{21}$ represents a non-diffusion group having from 8 to 32 carbon atoms in total; $R_{22}$ represents a hydrogen atom, or one or more of a halogen atom, a lower alkyl group, a lower alkoxyl group and a non-diffusion group having from 8 to 32 carbon atoms in total; $R_{23}$ represents a hydrogen atom or a substituent; two or more $R_{23}$, if present, may be the same or different; and n represents an integer of from 1 to 6.

Pivaloylacetanilide yellow couplers are described in detail in U.S. Pat. No. 4,622,287, Col. 3, line 15 to Col. 8, line 39 and U.S. Pat. No. 4,623,616, Col. 14, line 50 to Col. 19, line 41.

Benzoylacetanilide yellow couplers are described in detail in U.S. Pat. Nos. 3,408,194, 3,933,501, 4,046,575, 4,133,958, and 4,401,752.

Specific examples of pivaloylacetanilide yellow couplers include Compounds (Y-1) to (Y-39) disclosed in U.S. Pat. No. 4,622,287, Cols. 37 to 54. Preferred compounds are (Y-1), (Y-4), (Y-6), (Y-7), (Y-15), (Y-21), (Y-22), (Y 23), (Y-26), (Y-35), (Y-36), (Y-37), (Y-38), and (Y-39). Also additional examples are Compounds (Y-1) to (Y-33) listed in U.S. Pat. No. 4,623,616, Cols. 19 to 24. Preferred compounds are (Y-2), (Y-7), (Y-8), (Y-12), (Y-20), (Y-21), (Y-23), and (Y-29).

Other preferred yellow couplers include Compound (34) disclosed as a typical example in U.S. Pat. No. 3,408,194, Col. 6; Compounds (16) and (19) disclosed in U.S. Pat. No. 3,933,501, Col. 8; Compound (9) disclosed in U.S. Pat. No. 4,046,575, Cols. 7 and 8; Compound (1) disclosed in U.S. Pat. No. 4,133,958, Cols. 5 and 6; Compound No. 1 disclosed in U.S. Pat. No. 4,401,752, Col. 5, and Compounds (a) to (h) shown below.

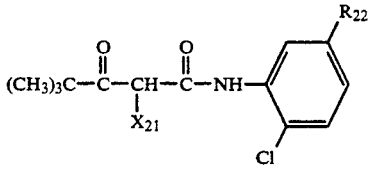

| Compound | $R_{22}$ | $X_{21}$ |
|---|---|---|
| a | $-COOCH(CH_3)COOC_{12}H_{25}$ | 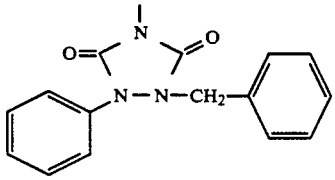 |
| b | $-COOCH(C_4H_9)COOC_{12}H_{25}$ | 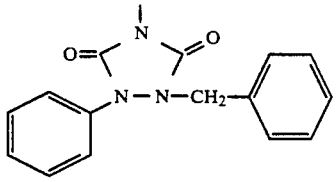 |
| c | 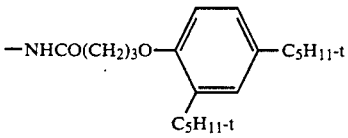 | 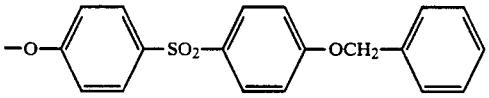 |
| d | " | 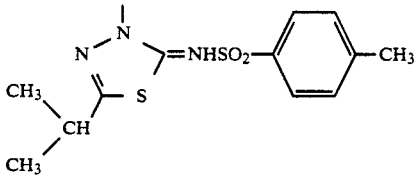 |
| e | " | 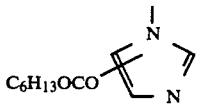 |
| f | $-NHSO_2C_{12}H_{25}$ | 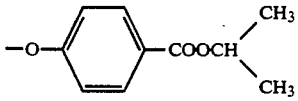 |
| g | $-NHSO_2C_{16}H_{33}$ | 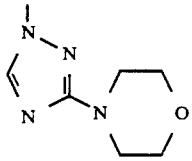 |

-continued

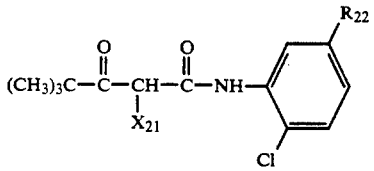

| Compound | $R_{22}$ | $X_{21}$ |
|---|---|---|
| h | $-NHC(=O)CH(CH_3)CH_2SO_2C_{12}H_{25}$ | 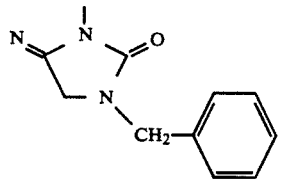 |

Of the above-described couplers, particularly preferred are those with a nitrogen atom as a releasable atom.

The magenta couplers which can be used in the present invention include oil-protect type indazolone or cyanoacetyl couplers, and preferably 5-pyrazolone couplers and pyrazoloazole couplers such as pyrazolotriazoles. The 5-pyrazolone couplers preferably include those substituted by an arylamino group or an acylamino group at the 3-position thereof from the standpoint of hue or density of the color developed. Typical examples of such couplers are described in U.S. Pat. Nos. 2,311,082, 2,343,703, 2,600,788, 2,908,573, 3,062,653, 3,152,896, and 3,936,015. The releasable group of 2-equivalent 5-pyrazolone couplers preferably includes nitrogen-releasable groups described in U.S. Pat. No. 4,310,619 and arylthio groups described in U.S. Pat. No. 4,351,897. 5-Pyrazolone couplers having a ballast group as described in European Patent 73636 provide high color densities.

Suitable pyrazoloazole couplers include pyrazolobenzimidazoles described in U.S. Pat. No. 2,369,879, preferably pyrazolo[5,1-c][1,2,4]triazoles described in U.S. Pat. No. 3,725,067, pyrazolotetrazoles described in *research Disclosure*, No. 24220 (June, 1984), and pyrazolopyrazoles described in *Research Disclosure*, No. 24230 (June, 1984). The above-described couplers may be polymer couplers.

Specific examples of these magenta couplers are represented by formulae (M-1), (M-2), and (M-3):

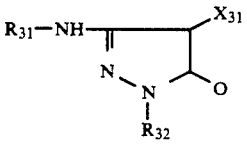

(M-1)

-continued

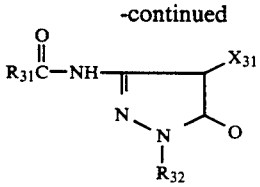

(M-2)

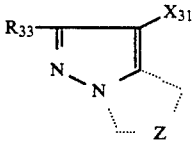

(M-3)

wherein $R_{31}$ represents a non-diffusion group having from 8 to 32 carbon atoms in total: $R_{32}$ represents a phenyl group or a substituted phenyl group; $R_{33}$ represents a hydrogen atom or a substituent; $Z_{31}$ represents a non-metallic atomic group necessary to form a 5-membered azole ring containing from 2 to 4 nitrogen atoms, this azole ring may have a substituent inclusive of a condensed ring; and $X_{31}$ represents a hydrogen atom or a releasable group.

In formula (M-3), the substituent represented by $R_{33}$ and the substituent of the azole ring are described in detail, e.g., in U.S. Pat. No. 4,540,654, Col. 2, line 41 to Col. 8, line 27.

Preferred pyrazoloazole couplers are imidazo[1,2-b]pyrazoles described in U.S. Pat. No. 4,500,630 from the standpoint of reduction of unnecessary yellow absorption and light-fastness of a color forming dye. The pyrazolo[1,5-b][1,2,4]triazoles described in U.S. Pat. No. 4,540,654 is particularly preferred.

Additional preferred pyrazoloazole magenta couplers are pyrazolotriazole couplers in which a branched alkyl group is directly bonded to the 2-, 3- or 6-position of the pyrazolotriazole ring thereof as described in JP-A-61-65245; pyrazoloazole couplers having a sulfonamide group in the molecule thereof as described in JP-A-61-65246 ; pyrazoloazole couplers having an alkoxyphenylsulfonamide group as a ballast group as described in JP-A-61-147254; and pyrazolotriazole couplers having an alkoxyl group or an aryloxy group at the 6-position thereof as described in European Patent (publication) 226,849.

Specific examples of these magenta couplers are shown below.

| Compound | $R_{33}$ | $R_{34}$ | $X_{31}$ |
|---|---|---|---|
| | | 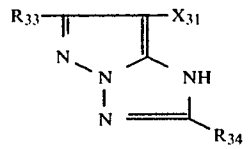 | |
| M-1 | $CH_3$— | 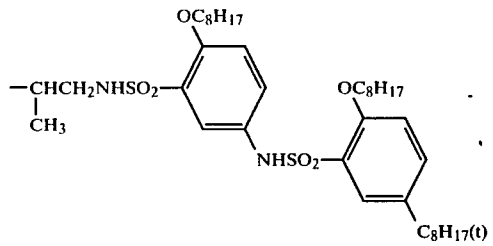 | Cl |
| M-2 | " | 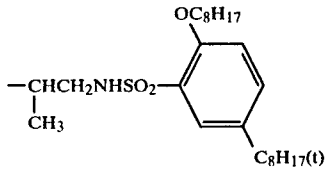 | " |
| M-3 | " | 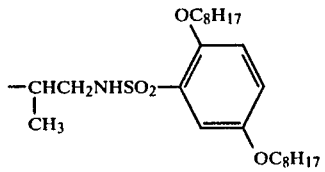 | 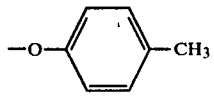 |
| M-4 | 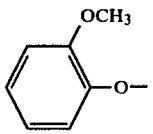 | 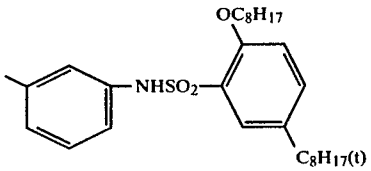 | 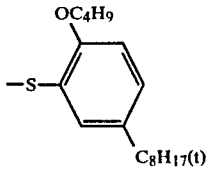 |

-continued
| | | | |
|---|---|---|---|
| M-5 | $CH_3$— | 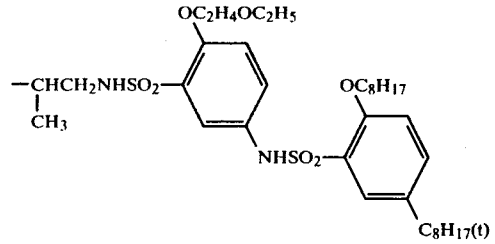 | Cl |
| M-6 | " | 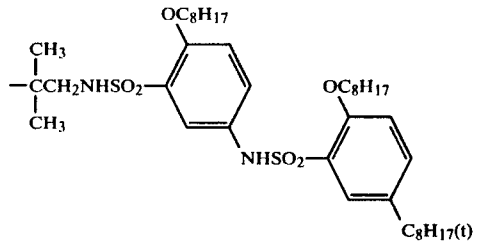 | " |
| M-7 | 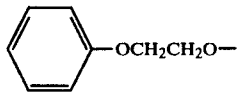 | 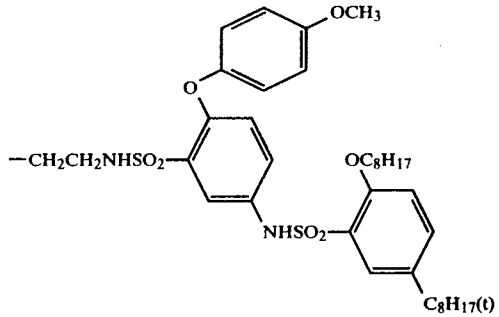 | 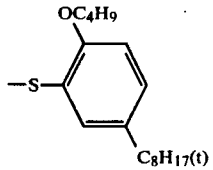 |
| M-8 | $CH_2CH_2O$— | " | " |
| M-9 | 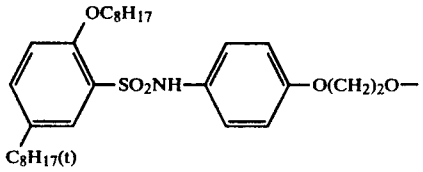 | 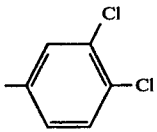 | " |

-continued
| | | | |
|---|---|---|---|
| M-10 | $CH_3$— | 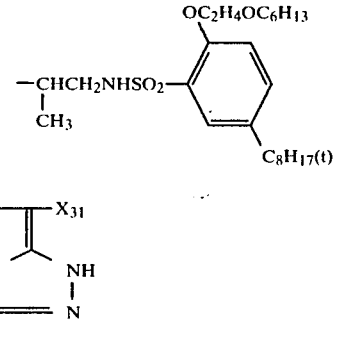 | Cl |
| M-11 | $CH_3$— | 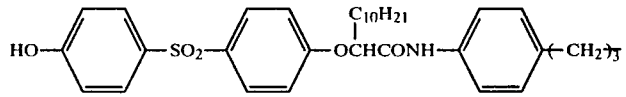 | Cl |
| M-12 | " | 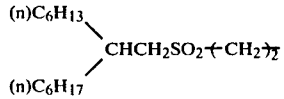 | " |
| M-13 | 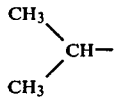 | 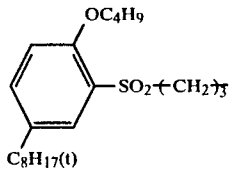 | " |
| M-14 | 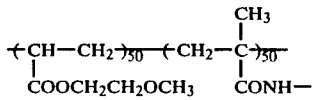 | 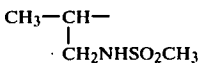 | " |
| M-15 | 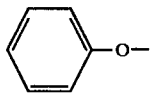 | 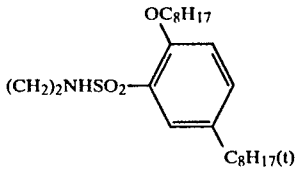 | Cl |

-continued
| | | | |
|---|---|---|---|
| M-16 | 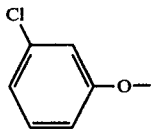 | 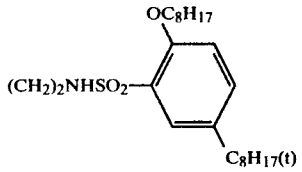 | 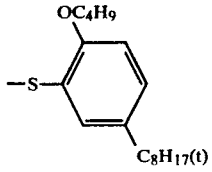 |
(M-17)
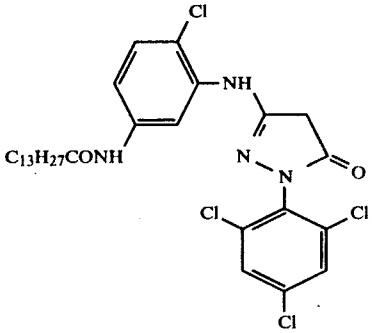
(M-18)
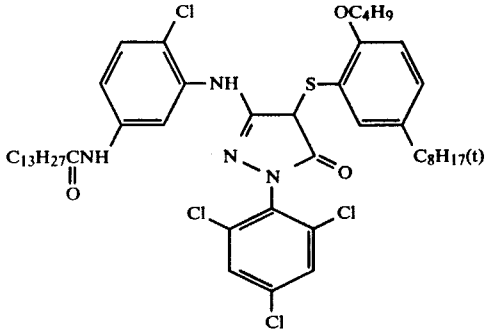
(M-19)
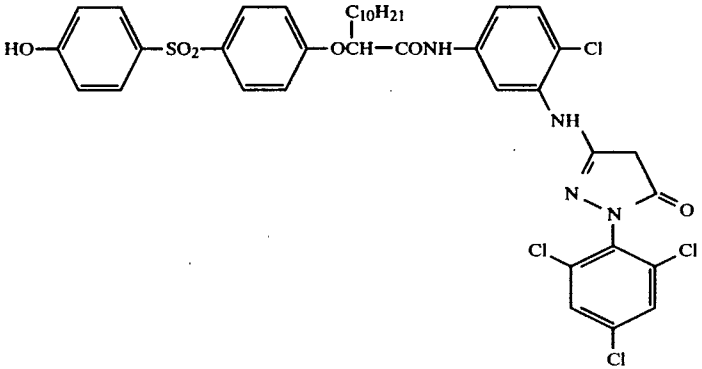
(M-20)
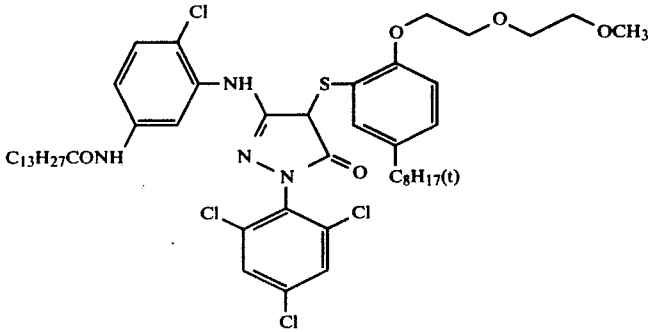

-continued
(M-21)
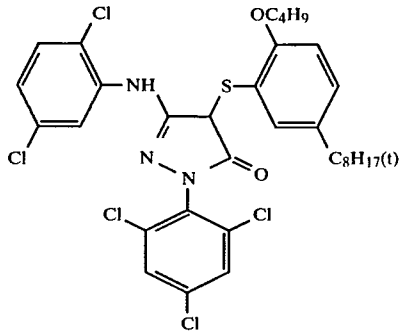
(M-22)
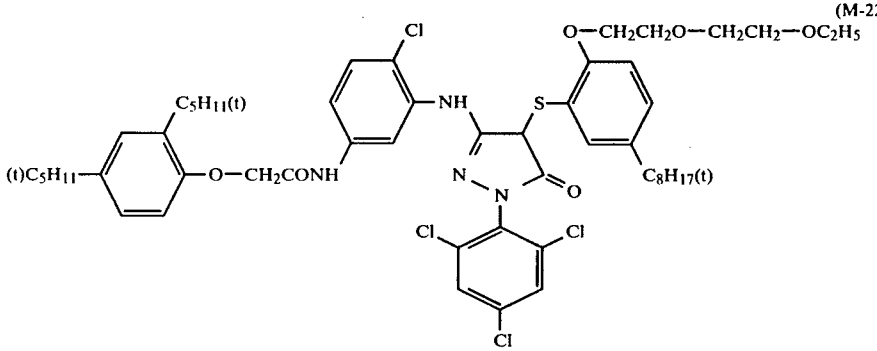
(M-23)
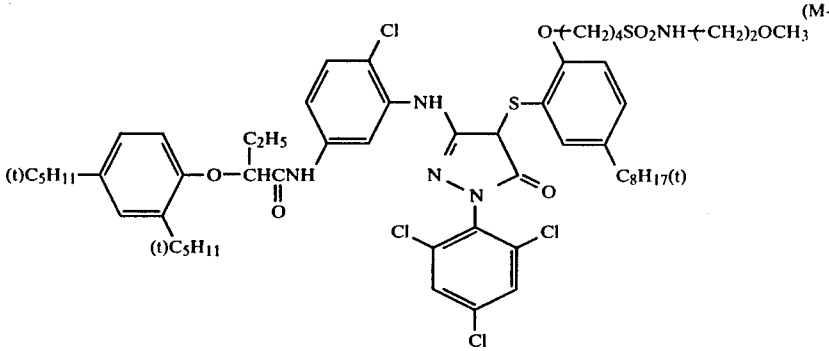
(M-24)
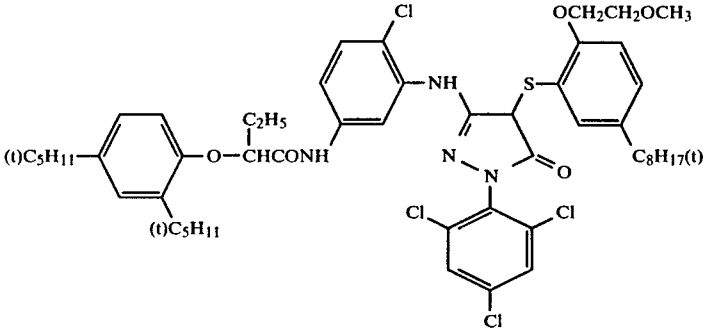
(M-25)
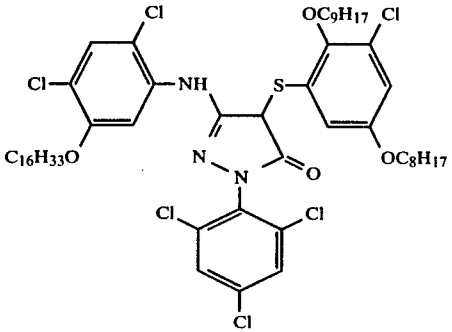
(M-26)
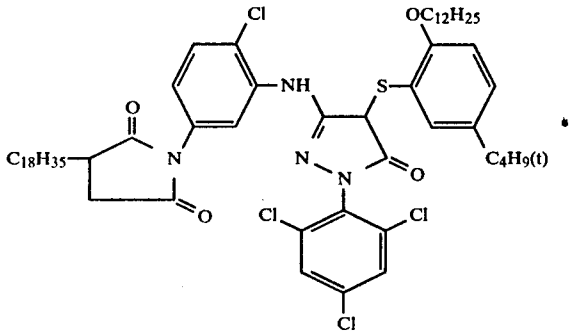

-continued
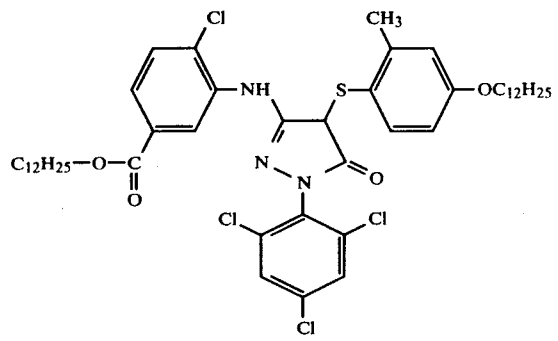
(M-27)
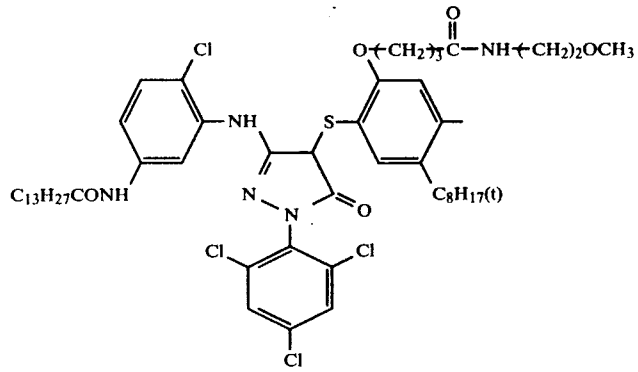
(M-28)
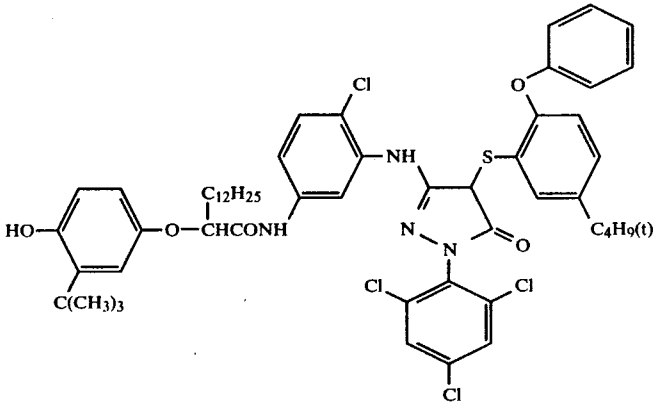
(M-29)
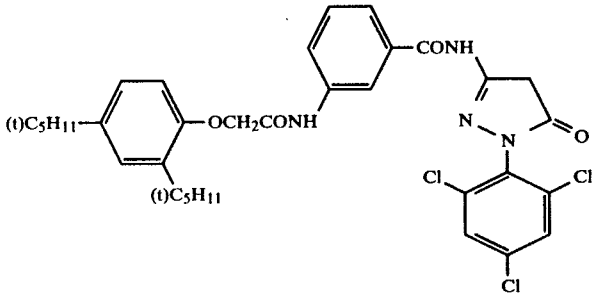
(M-30)

-continued
(M-31)
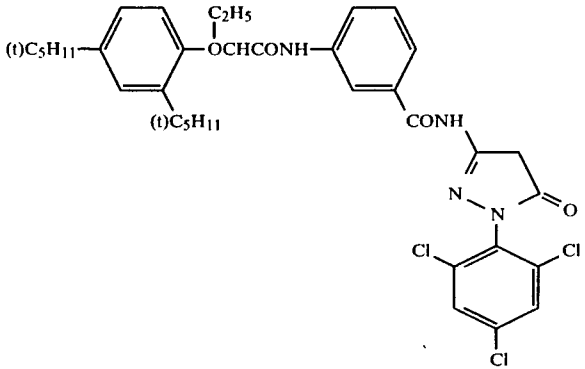
(M-32)
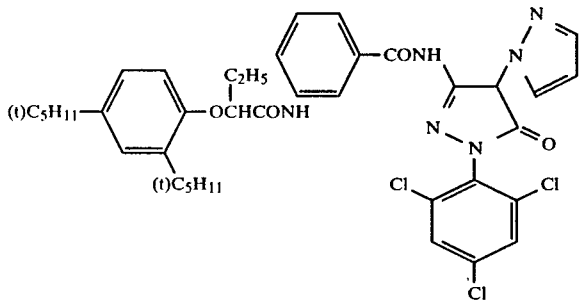
(M-33)
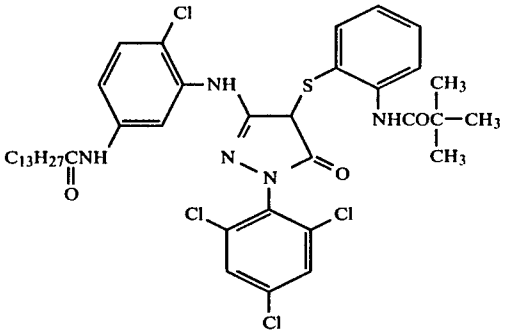
(M-34)
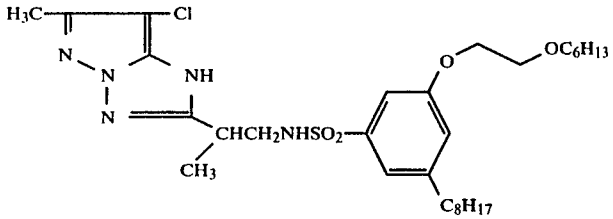

Suitable cyan couplers which can be used in the present invention typically include phenol cyan couplers and naphthol cyan couplers.

Suitable phenol cyan couplers include those having an acylamino group and an alkyl group at the 2- and 5-positions of the phenol nucleus thereof, respectively, (inclusive of polymer couplers) as described in U.S. Pat. Nos. 2,369,929, 4,518,687, 4,511,647, and 3,772,002. Specific examples of these phenolic couplers are the coupler of Example 2 of Canadian Patent 625,822, Compound (1) of U.S. Pat. No. 3,772,002, Compounds (I-4) and (I-5) of U.S. Pat. No. 4,564,590, Compounds (1), (2), (3) and (24) of JP-A-61-39045, and Compound (C-2) of JP-A-62-70846.

Suitable phenol cyan couplers further include 2,5-diacylaminophenol couplers described in U.S. Pat. Nos. 2,771,162, 2,895,826, 4,334,011, and 4,500,653 and JP-A-59-164555. Specific examples of these couplers are Compound (V) of U.S. Pat. No. 2,895,826, Compound (17) of U.S. Pat. No. 4,557,999, Compounds (2) and (12) of U.S. Pat. No. 4,565,777, Compound (4) of U.S. Pat. No. 4,124,396, and Compound (I-19) of U.S. Pat. No. 4,613,564.

Suitable phenol cyan couplers furthermore include those having a nitrogen-containing heterocyclic ring condensed to the phenol nucleus thereof, as disclosed in U.S. Pat. Nos. 4,372,173, 4,564,586, and 4,430,423, JP-A-61-390441 and JP-A-62-257158. Typical examples of these couplers are Couplers (1) and (3) of U.S. Pat. No. 4,327,173, Compounds (3) and (16) of U.S. Pat. No. 4,564,586, Compounds (1) and (3) of U.S. Pat. No. 4,430,423, and the following compounds.

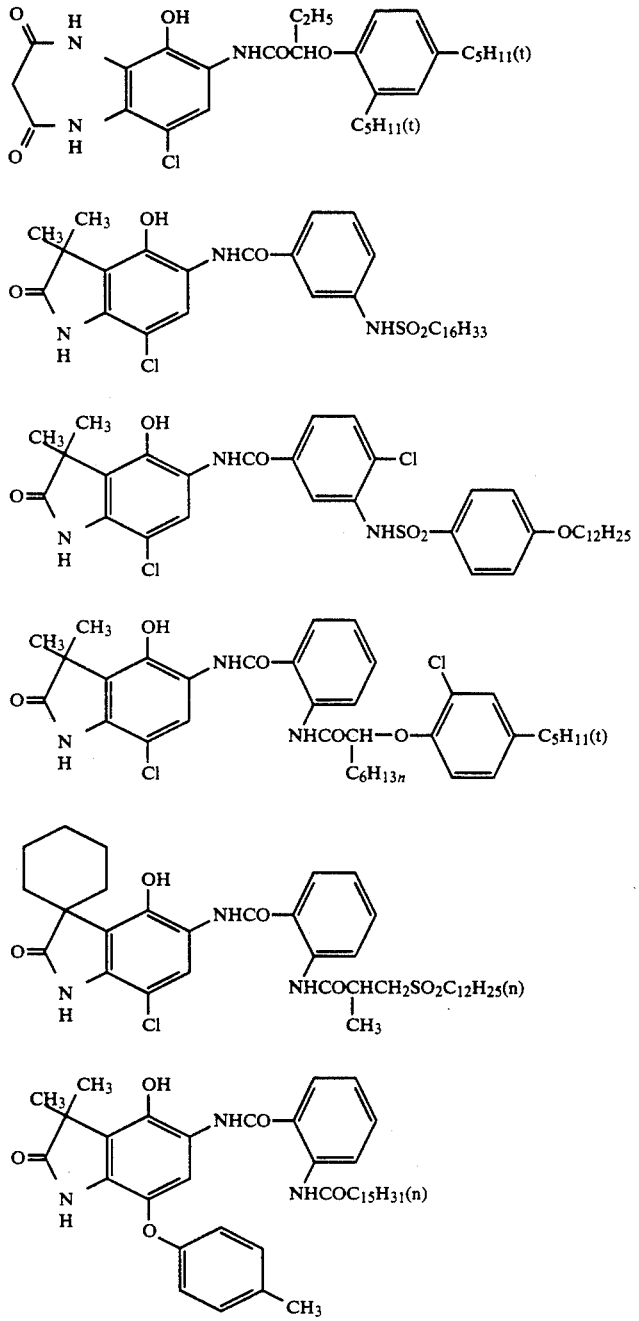

-continued
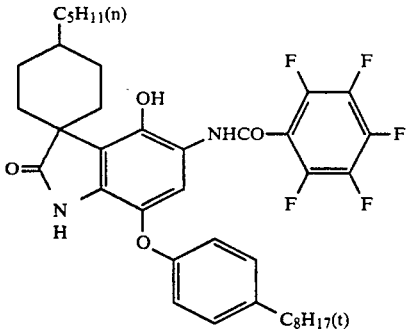
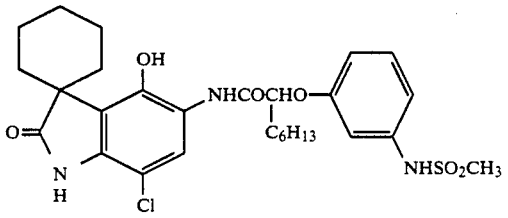
In addition to the above-described cyan couplers, diphenylimidazole cyan couplers described in EP 0,249,453A2 can also be used. Specific examples of these couplers are shown below.
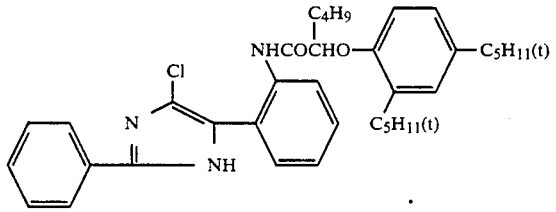
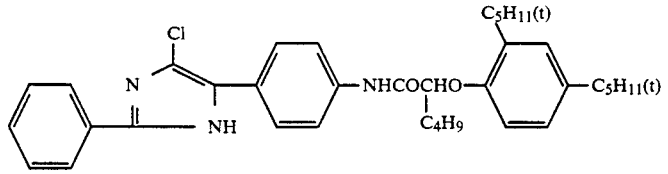
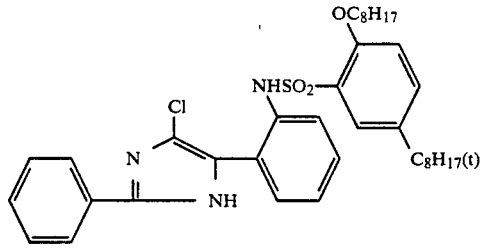
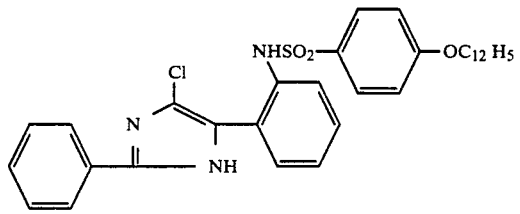

-continued

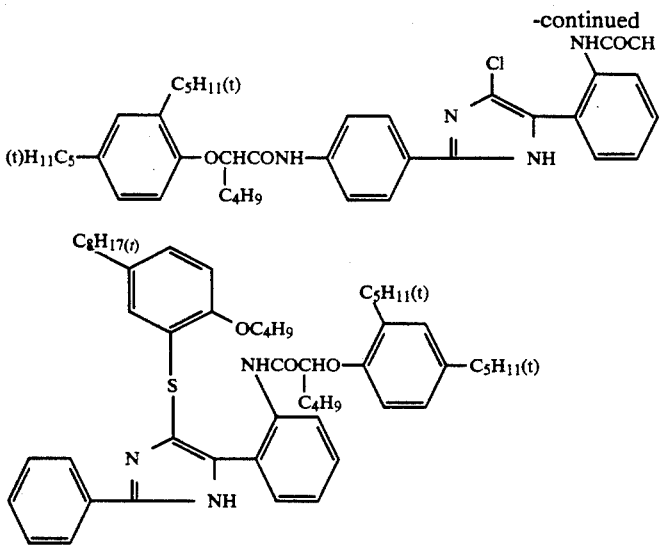

Examples of phenol cyan couplers additionally include ureide couplers described in U.S. Pat. Nos. 4,333,999, 4,451,559, 4,444,872, 4,427,767, and 4,579,813, and EP 067,689B1. Typical examples of these couplers are Coupler (7) of U.S. Pat. No. 4,333,999, Coupler (1) of U.S. Pat. No. 4,451,559, Coupler (14) of U.S. Pat. No. 4,444,872, Coupler (3) of U.S. Pat. No. 4,427,767, Couplers (6) and (24) of U.S. Pat. No. 4,609,619, Couplers (1) and (11) of U.S. Pat. No. 4,579,813, Couplers (45) and (50) of EP 067,689B1, and Coupler (3) of JP-A-61-42658.

Suitable naphthol cyan couplers include those having an N-alkyl-N-arylcarbamoyl group at the 2-position of the naphthol nucleus thereof (e.g., the couplers of U.S. Pat. No. 2,313,586), those having an alkylcarbamoyl group at the 2-position of the naphthol nucleus thereof (e.g., the couplers of U.S. Pat. Nos. 2,474,293 and 4,282,312), those having an arylcarbamoyl group at the 2-position [e.g., the couplers of JP-B-50-14523 (the term "JP-B" as used herein means an "examined Japanese patent publication")], those having a carbonamido or sulfonamido group at the 5-position (e.g., the couplers of JP-A-60-37448, JP-A-61-145557, and JP-A-61-153640), those having an aryloxy releasable group (e.g., the couplers of U.S. Pat. No. 3,476,563), those having a substituted alkoxy releasable group (e.g., the couplers of U.S. Pat. No. 4,296,199), and those having a glycol releasable group (e.g., the couplers of JP-B-60-39217).

The above-described couplers can be incorporated into an emulsion layer in the form of a dispersion in at least one high-boiling organic solvent. Preferred high-boiling organic solvents to be used include those represented by formulae (A) to (E):

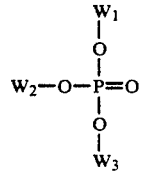

(A)

$W_1—COO—W_2$ (B)

-continued

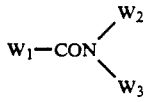

(C)

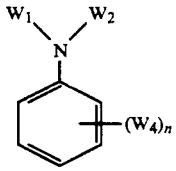

(D)

$W_1—O—W_2$ (E)

wherein $W_1$, $W_2$, and $W_3$, which may be the same or different, each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, Or S-$W_1$; n represents an integer of from 1 to 5; when n is 2 or more, $W_4$ may be the same or different; and $W_1$ and $W_2$ in formula (E) may form a condensed ring.

These couplers can be emulsified and dispersed in a hydrophilic colloid aqueous solution by impregnating such into a loadable latex polymer see U.S. Pat. No. 4,203,716) in the presence or absence of the above-described high-boiling organic solvent or by dissolving such in a water-insoluble and organic solvent-soluble polymer. The homo- or co-polymers described in International Publication No. WO 88/00723, pp. 12–30 are preferably used. In particular, acrylamide polymers are preferred from the standpoint of the stability of the dye image formed.

The light-sensitive materials of this invention may contain color fog inhibitors, such as hydroquinone derivatives, aminophenol derivatives, gallic acid derivatives, and ascorbic acid derivatives.

The light-sensitive materials of this invention can also contain various kinds of discoloration inhibitors, such as organic discoloration inhibitors for cyan, magenta and/or yellow images. Representative examples of organic discoloration inhibitors include hydroquinones, 6-hydroxychromans, 5-hydroxycoumarans, spirochromans, p-alkoxyphenols, hindered phenols (typically hindered bisphenols), gallic acid derivatives, methylenedioxybenzenes, aminophenols, hindered amines, and ether or ester derivatives of these phenolic compounds in which the phenolic hydroxyl group is silylated or alkylated. Metal complexes typically including (bissalicylaldoximato) nickel complexes and (bis-N,N-dialkyldithiocarbamato)nickel complexes can also be used.

Specific examples of organic discoloration inhibitors are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028 with respect to hydroquinones; U.S. Pat. Nos. 3,432,300, 3,573,050, 3,574,627, 3,698,909, and 3,764,337, and JP-A-52-152225 with respect to 6-hydroxychromans, 5-hydroxycoumarans, and spirochromans; U.S. Pat. No. 4,360,589 with respect to spiroindanes: U.S. Pat. No. 2,735,765, British Patent 2,066,975, JP-A-59-10539, and JP-B-57-19765 with respect to p-alkoxyphenols; U.S. Pat. No. 3,700,455, JP-A-52-72224, U.S. Pat. No. 4,228,235, and JP-B-52-6623 with respect to hindered phenols; U.S. Pat. Nos. 3,457,079 and 4,332,886, and JP-B-56-21144 with respect to gallic acid derivatives, methylenedioxybenzenes and aminophenols; U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344 with respect to hindered amines; U.S. Pat. Nos. 4,155,765, 4,174,220, 4,254,216, and 4,264,720, JP-A-54-145530, JP-A-55-6321, JP-A-58-105147, JP-A-59-10539, JP-B-57-37856, U.S. Pat. No. 4,279,990, and JP-B-53-3263 with respect to ether or ester derivatives of a phenolic hydroxyl group; and U.S. Pat. Nos. 4,050,938 and 4,241,155 and British Patent 2,027,731(A) with respect to metal complexes.

These compounds are usually co-emulsified with the corresponding coupler in an amount of from 5 to 100% by weight based on the coupler weight and incorporated into the light-sensitive layer. In order to prevent heat- and particularly light-deterioration of a cyan dye image, it is more effective to incorporate a ultraviolet absorbent into each of the layers adjacent to a cyan color forming layer.

Particularly preferred of the above-described discoloration inhibitors are spiroindanes and hindered amines.

In the present invention, it is preferable to use the above-described couplers, particularly pyrazoloazole couplers, in combination with (F) a compound capable of chemically bonding to a residual aromatic amine developing agent which remains after color development processing to form a chemically inert and substantially colorless compound and/or (G) a compound capable of chemically bonding to a residual oxidation product of an aromatic amine developing agent which remains after color development processing to form a chemically inert and substantially colorless compound. Addition of these compounds is effective to prevent stain formation or other undersirable side effects due to color forming dye formation reaction between residual color developing agent or an oxidation product thereof and the coupler during, for example, storage after processing.

Compounds (F) preferably include those capable of reacting with p-anisidine at a second-order reaction rate constant k2 (in trioctyl phosphate at 80° C.) falling within a range of from 1.0 l/min.sec to $1\times10^{-5}$ l/min.sec. Compounds having a k2 larger than this range are liable per se and tend to be decomposed upon reaction with gelatin or water. Compounds having a k2 smaller than this range are slow to react with the residual aromatic amine developing agent, sometimes failing to achieve the object of preventing side effects of the residual aromatic amine developing agent.

More preferred of compounds (F) are those represented by formulae (F-1) and (F-II):

$$R_{41}-(A)_n-X_{41} \quad \text{(F-1)}$$

$$R_{42}-\underset{\underset{B}{|}}{C}=Y_{41} \quad \text{(F-II)}$$

wherein $R_{41}$ and $R_{42}$ each represents an aliphatic, aromatic or 5- to 7-membered heterocyclic group; n represents 1 or 0; B represents a hydrogen atom, an aliphatic, aromatic or 5- to 7-membered heterocyclic group an acyl group, or a sulfonyl group; and $Y_{41}$ represents a group which accelerates the addition reaction of an aromatic amine developing agent to the compound of formula (F-II); $R_{41}$ and $X_{41}$ in formula (F-1) or $Y_{41}$ and $R_{42}$ or B in formula (F-II) may combine to form a cyclic structure.

The mode of chemical bonding between residual aromatic amine developing agent and the compound (F) typically includes a substitution reaction and an addition reaction.

Specific examples of compounds represented by formulae (F-1) and (F-II) are described in JP-A-63-249255, JP-A-1-55558, JP-A-1-57259 and JP-A-1-120554, Japanese Patent Application Nos. 62-158643 and 62-228034.

Details of the combination of the compound (G) and the compound (F) are described in JP-A-1-86139.

The light-sensitive material of the present invention may contain ultraviolet absorbents in the hydrophilic colloidal layers thereof. Examples of suitable ultraviolet absorbents include aryl-substituted benzotriazole compounds (e.g., the compounds described in U.S. Pat. No. 3,533,794), 4-thiazolidone compounds (e.g., the compounds described in U.S. Pat. Nos. 3,314,794 and 3,352,681), benzophenone compounds (e.g., the compounds described in JP-A-46-2784), cinnamic ester compounds (e.g., the compounds described in U.S. Pat. No. 3,705,805 and 3,707,375), butadiene compounds (e.g., the compounds described in U.S. Pat. No. 4,045,229), and benzoxidole compounds (e.g., the compounds described in U.S. Pat. No. 3,700,455). Ultraviolet absorbing couplers (e.g., α-naphthol cyan dye forming couplers) or ultraviolet absorbing polymers can also be used. The layer into which the ultraviolet absorbent is incorporated may be mordanted, if desired.

The hydrophilic colloidal layers may further contain a water-soluble dye as a filter dye or an anti-irradiation dye or for other purposes. Examples of such dyes include oxonol dyes, hemioxonol dyes, styryl dyes, merocyanine dyes, cyanine dyes, and azo dyes. Particularly useful dyes are oxonol dyes, hemioxonol dyes, and merocyanine dyes.

Suitable binders or protective colloids which can be used in the emulsion layers of the light-sensitive material of the present invention preferably include gelatin. Other hydrophilic colloids may also be used either alone or in combination with gelatin.

The gelatin which can be used includes both lime-processed gelatin and acid-processed gelatin. Details of the preparation of gelatin are described in Arthur Veis,

*The Macromolecular Chemistry of Gelatin*, Academic Press (1964).

Suitable supports which can be used in the present invention generally include transparent films, e.g., a cellulose nitrate film and a polyethylene terephthalate film, and a reflective support. A reflective support is preferred for achieving the objects of the present invention.

A reflective support has improved reflectivity to make a dye image formed in the silver halide emulsion layers clearer. The reflective support includes a base coated with a hydrophobic resin having dispersed therein a light reflective substance, e.g., titanium oxide, zinc oxide, calcium carbonate and calcium sulfate. Examples of such a reflective support are baryta paper, polyethylene coated paper, polypropylene synthetic paper, and a transparent support, e.g., a glass sheet, a polyester film (e.g., polyethylene terephthalate, cellulose triacetate, and cellulose nitrate), a polyamide film, a polycarbonate film, a polystyrene film, and a vinyl chloride film, which is combined with a reflective layer or a reflective substance. These supports can be selected depending on the end use.

As a light reflective substance, a white pigment is usually kneaded thoroughly in the presence of a surface active agent. It is preferable to pretreat the surface of the pigment particles with a di- to tetrahydric alcohol.

The area ratio (%) of white pigment particles per prescribed unit area can be obtained most typically by dividing the observed area into unit areas of 6 $\mu m \times 6$ $\mu m$ which are in contact with each other and measuring the ratio of the projected area occupied by the particles ($R_i$, %). The coefficient of variation of the area ratio ($R_i$) can be obtained from the ratio of the standard deviation (s) of $R_i$ to the mean value ($\overline{R}$) of $R_i$ ($s/\overline{R}$). The number of unit areas (n) is preferably 6 or more. The coefficient of variation $s/\overline{R}$ can thus be obtained from the equation:

$$s/\overline{R} = \sqrt{\frac{\sum_{n=1}^{n} (R_i - \overline{R})^2}{n-1}} \Big/ \frac{\sum_{i=1}^{n} R_i}{n}$$

In the present invention, the coefficient of variation (%) of the area ratio of the pigment particles is preferably not more than 0.15, more preferably not more than 0.12. When it is 0.08 or less, the dispersion of pigment particles can be regarded as substantially uniform.

The present invention is now illustrated in greater detail by way of the following Examples, but it should be understood that the present invention is not to be construed as being limited thereto. In these examples, all the percents given are by weight unless otherwise indicated.

EXAMPLE 1

A multilayer color light-sensitive material was prepared having the layer structure shown below. The resulting sample was designated Sample A.

The coating compositions for each of the layers was prepared as follows.

Coating Composition for First Layer:

In 150 ml of ethyl acetate, 1.0 ml of a solvent (Solv-3), and 3.0 ml of a solvent (Solv-4) were dissolved 60.0 g of a yellow coupler (ExY) and 28.0 g of a discoloration inhibitor (Cpd-1), and the resulting solution was added to 450 ml of a 10% gelatin aqueous solution containing sodium dodecylbenzenesulfonate, followed by dispersing in a ultrasonic homogenizer. The resulting dispersion was mixed with 420 g of a silver chlorobromide emulsion (silver bromide: 0.7 mol%) containing a blue-sensitive sensitizing dye shown below to prepare a coating composition for the First layer.

The coating compositions for the Second to Seventh layers were prepared in the same manner as for the composition for the First layer. Each layer further contained 1,2 bis(vinysulfonyl)ethane as a gelatin hardening agent.

The spectral sensitizing dye used in each emulsion layer was as follows.

Blue-Sensitive Emulsion Layer:

Anhydro-5,5'-dichloro-3,3'-disulfoethylthiacyanine hydroxide

Green-Sensitive Emulsion Layer:

Anhydro-9-ethyl-5,5'-diphenyl-3,3'-disulfoethyloxacarbocyanine hydroxide

Red-Sensitive Emulsion Layer:

3,3'-Diethyl-5-methoxy-9,9 -(2,2'-dimethyl-1,3-propano)thiadicarbocyanine iodide Each emulsion layer further contained a 7:2:1 (molar basis) mixture of 1-(2-acetaminophenyl)-5-mercaptotetrazole, 1 phenyl-5-mercaptotetrazole, and 1-(p-methoxyphenyl)-5-mercaptotetrazole as a stabilizer.

Disodium [3-carboxy-5-hydroxy-4-(3-(3-carboxy-5-oxo-1-(2, 5-disulfonatophenyl)-2-pyrazolin-4-ylidene)-1-propenyl)-1-pyrazolyl]benzene-2,5-disulfonate, tetrasodium N,N'-(4,8-dihydroxy-9,10-di-oxo-3,7-disulfonatoanthracene-1,5-diyl)bis(aminomethane-sulfonate), and sodium [3-cyano-5-hydroxy-4-(3-cyano-5-oxo-1-(4-sulfonatophenyl) -2-pyrazolin-4-ylidene)-1-pentanyl)-1-pyrazolyl]benzene-4-sulfonate were used as anti-irradiation dyes.

| Layer Structure: | |
|---|---|
| Support: | |
| Polyethylene-laminated (on both sides) paper support | |
| First Layer (Blue Sensitive Layer): | |
| Silver Halide Emulsion (AgBr: 0.7 mol %, cubic grains; mean grain size: 0.9 $\mu m$) | 0.27 g of Ag/m$^2$ |
| Gelatin | 1.80 g/m$^2$ |
| Yellow Coupler (ExY) | 0.60 g/m$^2$ |
| Discoloration Inhibitor (Cpd-1) | 0.28 g/m$^2$ |
| Solvent (Solv-3) | 0.01 g/m$^2$ |
| Solvent (Solv-4) | 0.03 g/m2 |
| Second Layer (Color Mixing Preventing Layer): | |
| Gelatin | 0.80 g/m$^2$ |
| Color Mixing Inhibitor (Cpd-2) | 0.055 g/m$^2$ |
| Solvent (Solv-1) | 0.03 g/m$^2$ |
| Solvent (Solv-2) | 0.015 g/m$^2$ |
| Third Layer (Green-Sensitive Layer): | |
| Silver Halide Emulsion (AgBr: 0.7 mol %; cubic grains; mean grain size: 0.45 $\mu m$) | 0.28 g of Ag/m$^2$ |
| Gelatin | 1.40 g/m$^2$ |
| Magenta Coupler (ExM) | 0.67 g/m$^2$ |
| Discoloration Inhibitor (Cpd-3) | 0.23 g/m$^2$ |
| Discoloration Inhibitor (Cpd-4) | 0.11 g/m$^2$ |
| Solvent (Solv-1) | 0.20 g/m$^2$ |
| Solvent (Solv-2) | 0.02 g/m$^2$ |
| Fourth Layer (Color Mixing Preventing Layer): | |
| Gelatin | 1.70 g/m$^2$ |
| Color Mixing Inhibitor (Cpd-2) | 0.065 g/m$^2$ |
| Ultraviolet Absorbent (UV-1) | 0.45 g/cm$^2$ |
| Ultraviolet Absorbent (UV-2) | 0.23 g/cm$^2$ |
| Solvent (Solv-1) | 0.05 g/cm$^2$ |
| Solvent (Solv-2) | 0.05 g/cm$^2$ |
| Fifth Layer (Red-Sensitive Layer): | |

-continued

| Layer Structure: | |
|---|---|
| Silver Halide Emulsion (AgBr: 2 mol %; cubic grains; mean grain size: 0.5 μm) | 0.19 g of Ag/m$^2$ |
| Gelatin | 1.80 g/cm$^2$ |
| Cyan Coupler (ExC-1) | 0.26 g/cm$^2$ |
| Cyan Coupler (ExC-2) | 0.12 g/cm$^2$ |
| Discoloration Inhibitor (Cpd-1) | 0.20 g/cm$^2$ |
| Solvent (Solv-1) | 0.16 g/cm$^2$ |
| Solvent (Solv-2) | 0.09 g/cm$^2$ |
| Sixth Layer (Ultraviolet Absorbing Layer): | |
| Gelatin | 0.70 g/cm$^2$ |
| Ultraviolet Absorbent (UV-1) | 0.26 g/cm$^2$ |
| Ultraviolet Absorbent (UV-2) | 0.07 g/cm$^2$ |
| Solvent (Solv-1) | 0.30 g/cm$^2$ |
| Solvent (Solv-2) | 0.09 g/cm$^2$ |
| Seventh Layer (Protective Layer): | |
| Gelatin | 1.07 g/cm$^2$ |

The compounds used in the preparation of Sample A were as follows:

Yellow Coupler (ExY):
α-Pivalyl-α-(3-benzyl 1-hydantoinyl)-2-chloro-5-[β-(dodecylsulfonyl)butylamido]acetanilide Magenta Coupler (ExM):
1-(2,4,6-Trichlorophenyl)-3-[2-chloro-5-(3-octadecenylsuccinimido)anilino]-5-pyrazolone Cyan Coupler (ExC-1):
2-Pentafluorobenzamido-4-chloro-5[2-(2,4-di-t-amylphenoxy)-3-methylbutylamidophenol Cyan Coupler (ExC-2):
2, 4 Dichloro-3-methyl-6-[α-( 2,4-di-t-amylphenoxy)-butylamido]phenol Discoloration Inhibitor (Cpd 1):
2,5-Di-t-amylphenyl-3,5-di-t-butylhydroxybenzoate Color Mixing Inhibitor (Cpd-2):
2,5-Di-t-octylhydroquinone Discoloration Inhibitor (Cpd-3):
1,4-Di-t-amyl-2,5-dioctyloxybenzene Discoloration Inhibitor (Cpd-4):
2,2'-Methylenebis(4-methyl-6-t-butylphenol)

(Cpd-5):
p-(p-Toluenesulfonamido)phenyldodecane

Solvent (Solv 1):
Di(2-ethylhexyl)phthalate

Solvent (Solv-2):
Dibutyl phthalate

Solvent (Solv-3):
Di(i-nonyl)phthalate

Solvent (Solv-4):
N,N-Diethylcarbonamidomethoxy-2 4-di-t-amylbenzene

Ultraviolet Absorbent (UV-1):
2-(2-Hydroxy-3,5-di-t-amylphenyl)benzotriazole

Ultraviolet Absorbent (UV-2):
2-(2-Hydroxy-3,5-di-t-butylphenyl)benzotriazole

Samples B to E were prepared in the same manner as for Sample A, except for varying the halogen composition of the silver chlorobromide emulsion of the red-sensitive emulsion layer a shown in Table 1 below.

TABLE 1

| Sample | Cl Content (mol %) of Red-Sensitive Emulsion |
|---|---|
| A | 98 |
| B | 100 |
| C | 95 |
| D | 90 |

TABLE 1-continued

| Sample | Cl Content (mol %) of Red-Sensitive Emulsion |
|---|---|
| E | 70 |

Each of Samples A to E was sensitometrically exposed to light by the use of a sensitometer "FWH Type" manufactured by Fuji Photo Film Co., Ltd. (color temperature: 3200° K). The exposure was conducted so as to give an exposure amount of 250 CMS in 1/10 the second.

The sample was continuously processed according to the following procedure using an automatic developing machine.

| Processing Procedure: Processing Step | Temperature (°C.) | Time (sec) |
|---|---|---|
| Color Development | 38 | 45 |
| Bleach-Fix | 30–36 | 45 |
| Rinsing (1) | 30–37 | 30 |
| Rinsing (2) | 30–37 | 30 |
| Rinsing (3) | 30–37 | 30 |
| Drying | 70–80 | 60 |

Each processing solution had the following composition

| Color Developer: | |
|---|---|
| Water | 800 ml |
| Ethylenediamine-N,N,N',N'-tetramethylene-phosphonic Acid | 3.0 g |
| Organic Preservative (I-1) | 0.03 mol |
| Sodium Chloride | see Table 2 |
| Potassium Bromide | see Table 2 |
| Potassium Carbonate | 25 g |
| N-Ethyl-N-(β-methanesulfonamidoethyl)-3-methyl-4-aminoaniline Sulfate | 5.0 g |
| Triethanolamine | 10.0 g |
| Fluorescent Whitening Agent (4,4'-diaminostilbene type) | 2.0 g |
| Sodium Sulfite | 0.01 g |
| Water to make | 1,000 ml |
| pH (25° C.) | 10.05 |
| Bleach-Fix Solution | |
| Water | 400 ml |
| Ammonium Thiosulfate (70%) aq. soln. | 100 ml |
| Ammonium (Ethylenediaminetetraacetato)iron (III) | 55 g |
| Disodium Ethylenediaminetetraacetate | 5 g |
| Ammonium Bromide | 40 g |
| Glacial Acetic Acid | 9 g |
| Water to make | 1,000 ml |
| pH (25° C.) | 5.40 |

Rinsing Solution:

Ion-exchanged water containing not more than 3 ppm of each of calcium and magnesium.

The red sensitivity S (the reciprocal of the exposure amount necessary to provide a cyan density of 0.5, expressed relatively taking that of Sample A as 100), the maximum cyan density ($D_{max}$ and the minimum cyan density ($D_{min}$) was determined for each processed sample. The results obtained are shown in Table 2.

Further, the same sensitometry as described above was repeated, except for using the color developer after it was allowed to stand at room temperature for 2 weeks with an opening ratio of the developer (ratio of the open area of the development tank to the volume of the developer) being set at 0.02 cm$^{-1}$. The increase of the minimum density ($D_{min}$) due to the aging of the developer was determined, and the results obtained are also shown in Table 2 below.

TABLE 2

| Run No. | Sample | $Cl^{-1}$ Ion Concentration (mol/l) | $Br^{-1}$ Ion Concentration (mol/l) | S | $D_{max}$ | $D_{min}$ | $\Delta D_{min}$ | Remarks |
|---|---|---|---|---|---|---|---|---|
| 1 | A | $8 \times 10^{-2}$ | $4 \times 10^{-4}$ | 100 | 2.80 | 0.09 | 0 | Invention |
| 2 | B | $8 \times 10^{-2}$ | $4 \times 10^{-4}$ | 63 | 2.80 | 0.12 | 0.03 | Comparison |
| 3 | C | $8 \times 10^{-2}$ | $4 \times 10^{-4}$ | 120 | 2.78 | 0.09 | 0 | Invention |
| 4 | D | $8 \times 10^{-2}$ | $4 \times 10^{-4}$ | 82 | 2.42 | 0.10 | 0.02 | Comparison |
| 5 | E | $8 \times 10^{-2}$ | $4 \times 10^{-4}$ | 60 | 2.27 | 0.11 | 0.03 | " |
| 6 | A | $8 \times 10^{-2}$ | 0 | 102 | 2.80 | 0.11 | 0.04 | " |
| 7 | A | $8 \times 10^{-2}$ | $2 \times 10^{-3}$ | 70 | 2.50 | 0.10 | 0 | " |
| 8 | A | $5 \times 10^{-3}$ | $4 \times 10^{-4}$ | 105 | 2.82 | 0.11 | 0.03 | " |
| 9 | A | $2 \times 10^{-1}$ | $4 \times 10^{-4}$ | 80 | 2.46 | 0.10 | 0 | " |

As is shown by the results in Table 2, the image formation method according to the present invention exhibit satisfactory performance in sensitivity and maximum and minimum densities while suppressing variation in photographic characteristics, particularly of minimum density, in continuous processing.

EXAMPLE 2

A multilayer color light-sensitive material was prepared with the following layer structure. This sample was designated as Sample F.

The coating composition for each layer was prepared as follows.

Coating Composition for First Layer:

In 27.2 ml of ethyl acetate and 8.2 g of a solvent (Solv-3) were dissolved 19.1 g of a yellow coupler (ExY), 4.4 g of a dye image stabilizer (Cpd-1), and 0.7 g of a dye image stabilizer (Cpd-7), and the resulting solution was emulsified and dispersed in 185 ml of a 10% gelatin aqueous solution containing 8 ml of a 10% sodium dodecylbenzenesulfonate aqueous solution.

Separately, each of the blue-sensitive sensitizing dyes shown below was added to a silver chlorobromide emulsion (cubic grains; mean grain size: 0.88 μm; coefficient of grain size variation: 0.08; containing 0.2 mol% of silver bromide on the surface) in an amount of 2.0 $\times 10^{-4}$ mol per mol of silver halide, and the emulsion was then subjected to sulfur sensitization.

The above-prepared dispersion and the emulsion were mixed to prepare a coating composition having the composition described below.

Coating compositions for the Second to Seventh layers were prepared in the same manner as described above.

Each layer contained sodium 1-hydroxy-3,5-dichloro-s-triazine as a gelatin hardening agent.

The spectral sensitizing dyes used in each silver halide emulsion layer and their amounts were as follows.

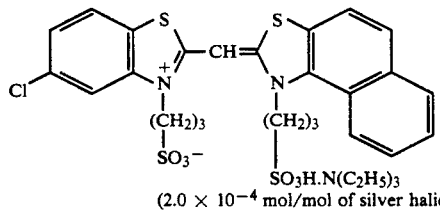

($2.0 \times 10^{-4}$ mol/mol of silver halide)

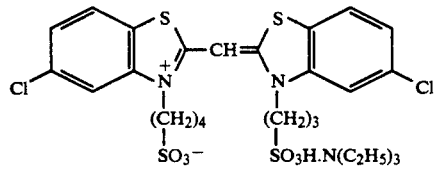

($2.0 \times 10^{-4}$ mol/mol of silver halide)

Green-Sensitive Emulsion Layer:

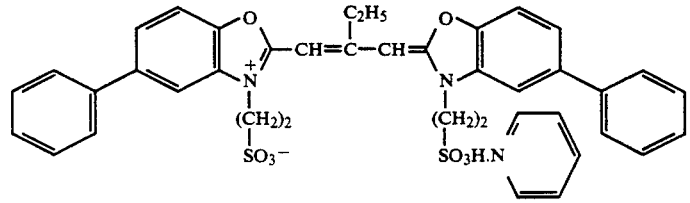

($4.0 \times 10^{-4}$ mol/mol of silver halide)

-continued

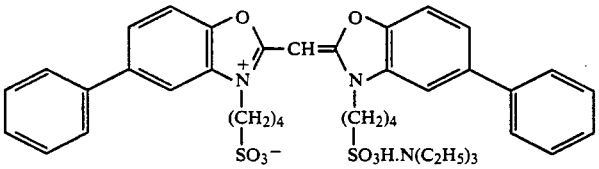

($7.0 \times 10^{-5}$ mol/mol of silver halide)

Red-Sensitive Emulsion Layer:

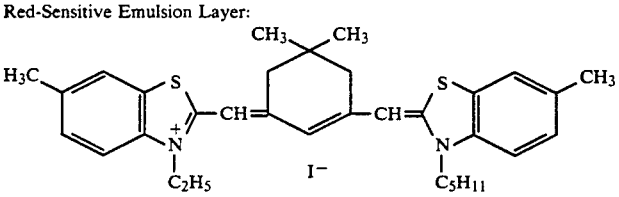

($0.9 \times 10^{-4}$ mol/mol of silver halide)

The red-sensitive emulsion layer additionally contained a compound shown below in an amount of $2.6 \times 10^{-3}$ mol/mol of silver halide.

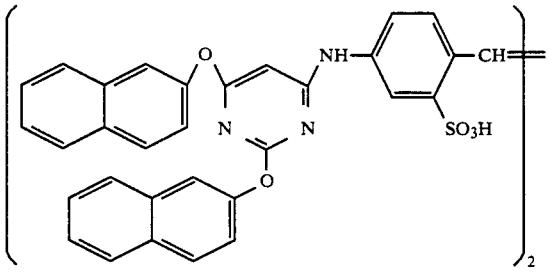

Each of the blue-sensitive emulsion layer, the green-sensitive emulsion layer, and the red-sensitive emulsion layer further contained 1-(5-methylureidophenyl)-5-mercaptotetrazole in an amount of $8.5 \times 10^{-5}$ mol, $7.7 \times 10^{-4}$ mol, and $2.5 \times 10^{-4}$ mol, per mol of silver halide, respectively.

Each of the emulsion layers furthermore contained the following dyes for prevention of irradiation.

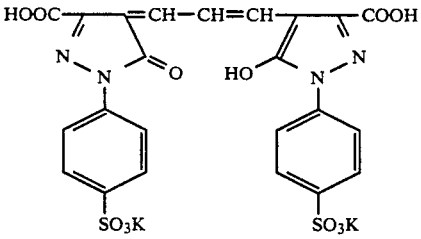

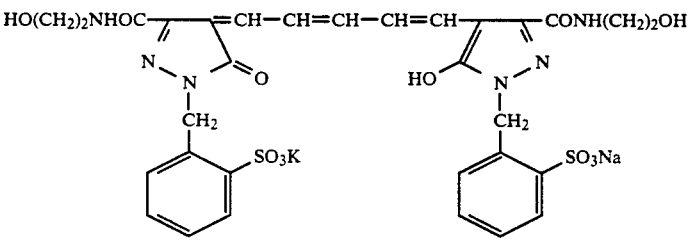

| Layer Structure: | |
|---|---|
| Support: | |
| Polyethylene-laminated paper [the polyethylene layer on the side to be coated with the First Layer contained a white pigment, $TiO_2$, and a bluing dye (ultramarine)]. | |
| First Layer (Blue-Sensitive Layer): | |
| Silver Chlorobromide Emulsion | 0.30 g of Ag/m$^2$ |
| Gelatin | 1.86 g/m$^2$ |
| Yellow Coupler (ExY) | 0.82 g/m$^2$ |
| Dye Image Stabilizer (Cpd-1) | 0.19 g/m$^2$ |
| Solvent (Solv-3) | 0.35 g/m$^2$ |
| Dye Image Stabilizer (Cpd-7) | 0.06 g/m$^2$ |
| Second Layer (Color Mixing Preventing Layer): | |
| Gelatin | 0.99 g/m$^2$ |
| Color Mixing Inhibitor (Cpd-5) | 0.08 g/m$^2$ |
| Solvent (Solv-1) | 0.16 g/m$^2$ |
| Solvent (Solv-4) | 0.08 g/m$^2$ |
| Third Layer (Green-sensitive Layer): | |
| Silver Chlorobromide Emulsion [1:3 (by Ag molar ratio) of an emulsion containing cubic grains having a mean grain size of 0.55 μm and a coefficient of grain size variation of 0.10 and that having a mean grain size | 0.12 g of Ag/m$^2$ |

-continued

| Layer Structure: | |
|---|---|
| of 0.39 μm and a coefficient of grain size variation of 0.08; 0.8 mol % of AgBr localized on the surface of grains] | |
| Gelatin | 1.24 g/m$^2$ |
| Magenta Coupler (ExM) | 0.27 g/m$^2$ |
| Dye Image Stabilizer (Cpd-3) | 0.15 g/m$^2$ |
| Dye Image Stabilizer (Cpd-8) | 0.02 g/m$^2$ |
| Dye Image Stabilizer (Cpd-9) | 0.03 g/m$^2$ |
| Solvent (Solv-2) | 0.54 g/m$^2$ |
| Fourth Layer (Ultraviolet Absorbing Layer): | |
| Gelatin | 1.58 g/m$^2$ |
| Ultraviolet Absorbent (UV-1) | 0.47 g/m$^2$ |
| Color Mixing Inhibitor (Cpd-5) | 0.05 g/m$^2$ |
| Solvent (Solv-5) | 0.24 g/m$^2$ |
| Fifth Layer (Red-Sensitive Layer): | |
| Silver Chlorobromide Emulsion [1:4 (Ag molar ratio) mixture of an emulsion containing cubic grains having a mean grain size of 0.58 μm and a coefficient of grain size variation of 0.09 and that having a mean grain size of 0.45 μm and a coefficient of grain size variation of 0.11; 0.6 mol % of AgBr localized on part of the gain surface] | 0.23 g of Ag/m$^2$ |
| Gelatin | 1.34 g/m$^2$ |
| Cyan coupler (ExC) | 0.32 g/m$^2$ |
| Dye Image Stabilizer (Cpd-6) | 0.17 g/m$^2$ |
| Dye Image Stabilizer (Cpd-10) | 0.04 g/m$^2$ |
| Dye Image Stabilizer (Cpd-7) | 0.40 g/m$^2$ |
| Solvent (Solv-6) | 0.15 g/m$^2$ |
| Sixth Layer (Ultraviolet Absorbing Layer): | |
| Gelatin | 0.53 g/m$^2$ |
| Ultraviolet Absorbent (UV-1) | 0.16 g/m$^2$ |
| Color Mixing Inhibitor (Cpd-5) | 0.02 g/m$^2$ |
| Solvent (Solv-5) | 0.08 g/m$^2$ |
| Seventh Layer (Protective Layer): | |
| Gelatin | 1.33 g/m$^2$ |
| Acryl-modified Copolymer of Polyvinyl Alcohol (degree of modification: 17%) | 0.17 g/m$^2$ |
| Liguid Paraffin | 0.03 g/m$^2$ |

The compounds used in the preparation of Sample F were as follows.

Yellow Coupler (ExY):

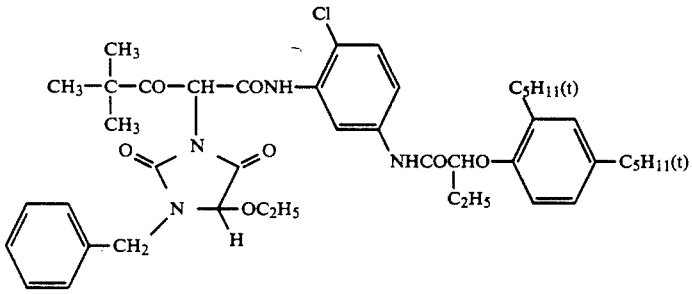

Magenta Coupler (ExM):

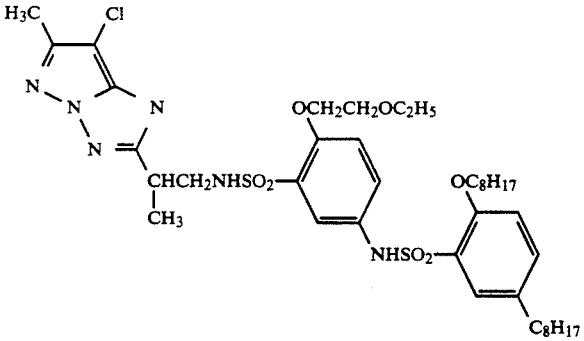

Cyan Coupler (ExC):

A 2:4:4 (by weight) mixture of

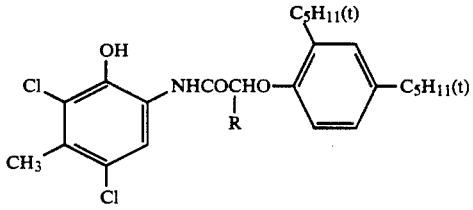

R = $C_2H_5$, $C_4H_9$

-continued
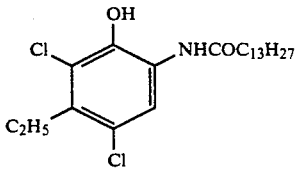
Dye Image Stabilizer (Cpd-1):
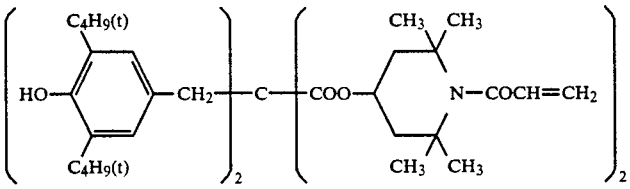
Dye Image Stabilizer (Cpd-3):
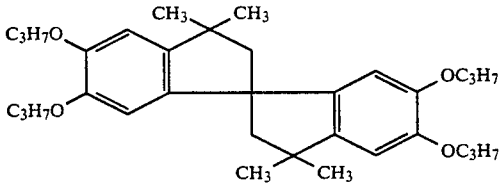
Color Mixing Inhibitor (Cpd-5):
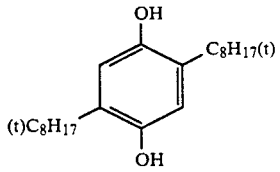
Dye Image Stabilizer (Cpd-6):
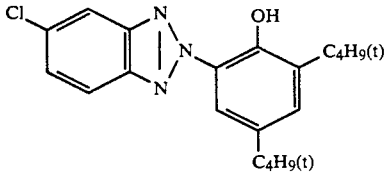
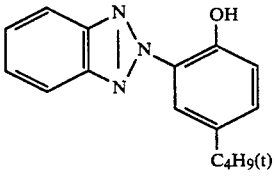
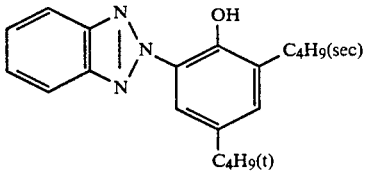
Dye Image Stabilizer (Cpd-7):
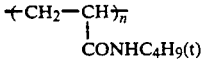
(average molecular weight: 60,000)

-continued
Dye Image Stabilizer (Cpd-8):
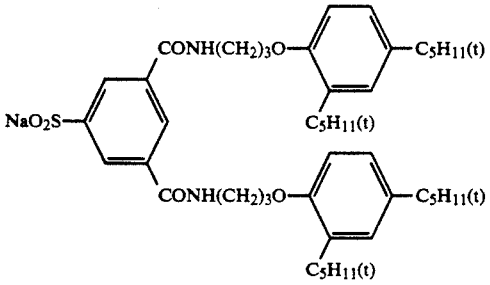
Dye Image Stabilizer (Cpd-9):
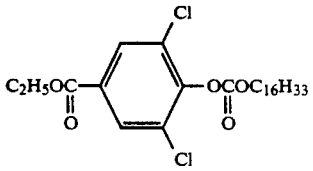
Dye Image Stabilizer (Cpd-10):
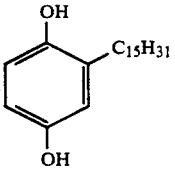
Ultraviolet Absorbent (UV-1):
A 4:2:4 (by weight) mixture of
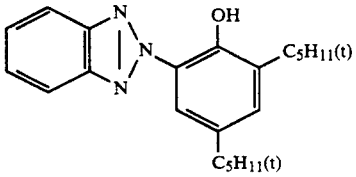
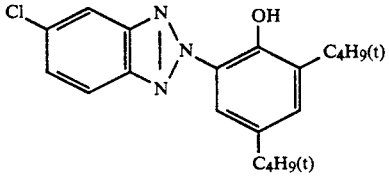
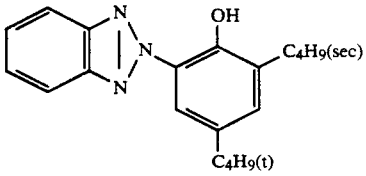
Solvent (Solv-1):
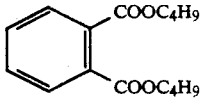
Solvent (Solv-2):
A 2:1 (by volume) mixture of
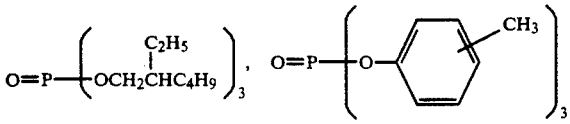
Solvent (Solv-3):
$O{=}P{\leftarrow}O{-}C_9H_{19}(iso))_3$ -continued Solvent (Solv-4):

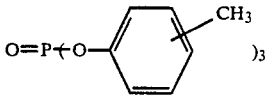

Solvent (Solv-5):

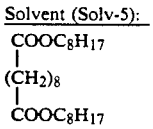

Solvent (Solv-6):

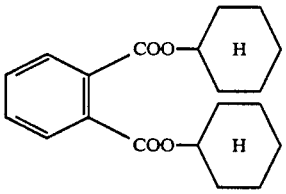

Sample F was imagewise exposed in the same manner as in Example 1 and continuously processed according to the following procedure using a color paper processor until the amount of a color developer replenisher supplied reached double the volume of the developer tank (hereinafter referred to as a running test).

| Processing Step | Temperature (°C.) | Time (sec) | Replenishment (ml/m²) | Tank Volume (l) |
|---|---|---|---|---|
| Color Development | 38 | 45 | 100 | 4 |
| Bleach-Fix | 30–36 | 45 | 61 | 4 |
| Stabilization (1)* | 30–37 | 30 | — | 2 |
| Stabilization (2)* | 30–37 | 30 | — | 2 |
| Stabilization (3)* | 30–37 | 30 | 364 | 2 |
| Drying | 70–85 | 60 | | |

Note:
*Washing was effected in a counter manner of from (3) toward (1). The washing solution (1) was introduced into the bleach-fix bath at a rate of replenishment of 122 ml/m².

During the continuous processing, each of the color developer, the bleach-fix solution, and the washing solution was replenished with distilled water in an amount corresponding to the evaporation loss.

Each processing solution had the following composition.

| | |
|---|---|
| Color Developer: | |
| [Running Solution] | |
| Water | 800 ml |
| Ethylenediamine-N,N,N'N'-tetra-methylenephosphonic Acid | 3.0 g |
| Triethanolamine | 8.0 g |
| Sodium Chloride | see Table 3 |
| Potassium Bromide | see Table 3 |
| Potassium Carbonate | 25 g |
| N-Ethyl-N-(β-methanesulfonamido-ethyl)-3-methyl-4-aminoaniline Sulfate | 5.0 g |
| Organic Preservative A (II-19) | 0.03 mol |
| Fluorescent Whitening Agent | 1.0 g |

-continued

| | |
|---|---|
| ("WHITEX-4" produced by Sumitomo Chemical Co., Ltd.) | |
| Water to make | 1000 ml |
| pH (25° C.) | 10.05 |
| [Replenisher] | |
| Ethylenediamine-N,N,N',N',-tetra-methylenephosphonic Acid | 3 g/l |
| Triethanolamine | 12 g/l |
| Potassium Chloride | see Table 3 |
| Potassium Bromide | see Table 3 |
| Potassium Carbonate | 26 g/l |
| N-Ethyl-N-(β-methanesulfonamido-ethyl)-3-methyl-4-aminoaniline Sulfate | 9 g/l |
| Organic Preservative (II-19) | 7 g/l |
| "WHITEX-4" | 2.5 g/l |
| Water to Make | 1000 ml |
| pH (25° C.) (adjusted with KOH or $H_2SO_4$) | 10.55 |
| Bleach Fix Solution: | |
| [Running Solution] | |
| Water | 400 ml |
| Ammonium Thiosulfate (70%) | 100 ml |
| Ammonium Sulfite | 38 g |
| Ammonium (Ethylenediaminetetraacetato)-iron (III) | 55 g |
| Disodium Ethylenediaminetetraacetate | 5 g |
| Glacial Acetic Acid | 9 g |
| Water to make | 1000 ml |
| pH (25° C.) | 5.40 |
| 8 [Replenisher] | |
| A 2.5-fold concentrate of the running solution. | |
| Rinsing Solution: | |
| [Running Solution = Replenisher] | |
| Ion-exchanged water containing not more than 3 ppm each of calcium and magnesium. | |

The maximum cyan density $D_{max}$ and the minimum cyan density $D_{min}$ of the sample processed at the beginning of the running test and the increase of the minimum cyan density ($D_{min}$) by the end of the running test were determined. The results obtained are shown in Table 3 below.

TABLE 3

| Run No. | Sample | $Cl^{-1}$ Ion Concn. (mol/l) Running Solution | $Cl^{-1}$ Ion Concn. (mol/l) Replenisher | $Br^{-1}$ Ion Concn. (mol/l) Running Solution | $Br^{-1}$ Ion Concn. (mol/l) Replenisher | $D_{max}$ | $D_{min}$ | $\Delta D_{min}$ | Remarks |
|---|---|---|---|---|---|---|---|---|---|
| 10 | F | $4 \times 10^{-2}$ | 0 | $1 \times 10^{-4}$ | 0 | 2.94 | 0.10 | 0 | Invention |
| 11 | F | $6 \times 10^{-2}$ | $2.7 \times 10^{-2}$ | $3 \times 10^{-4}$ | $1.3 \times 10^{-4}$ | 2.91 | 0.10 | 0 | " |
| 12 | F | $1 \times 10^{-2}$ | 0 | $2 \times 10^{-5}$ | 0 | 2.90 | 0.13 | 0.03 | Comparison |

TABLE 3-continued

| Run No. | Sample | $Cl^{-1}$ Ion Concn. (mol/l) Running Solution | Replenisher | $Br^{-1}$ Ion Concn. (mol/l Running Solution | Replenisher | $D_{max}$ | $D_{min}$ | $\Delta D_{min}$ | Remarks |
|---|---|---|---|---|---|---|---|---|---|
| 13 | F | $4 \times 10^{-2}$ | 0 | 0 | 0 | 2.93 | 0.10 | 0.04 | " |

The results of Table 3 reveal the effects of the present invention in the multilayer light-sensitive material of Example 2.

As described above, the present invention provides an image formation method exhibiting high sensitivity, a high maximum density, and a low minimum density, while markedly inhibiting variations in photographic characteristics, particularly of minimum density, in continuous processing.

While the invention has been described in detail and with reference to specific embodiments thereof, it will be apparent to one skilled in the art that various changes and modifications can be made therein without departing from the spirit and scope thereof.

What is claimed is:

1. A method for forming an image which comprises developing an imagewise exposed silver halide color photographic material comprising a support having thereon at least one blue-sensitive silver halide emulsion layer, at least one green-sensitive silver halide emulsion layer, and at least one red-sensitive silver halide emulsion layer with a color developer containing at least one aromatic primary amine color developing agent, wherein said red-sensitive silver halide emulsion layer contains silver chlorobromide having not more than 1 mol% of silver iodide and having a silver bromide content of from 0.5 to 6 mol%, wherein said blue-sensitive silver halide emulsion layer and said green-sensitive silver halide emulsion layer each comprises a high silver chloride emulsion having a silver chloride content of at least 98 mol%, the total silver coverage of the photographic material is 0.80 g/m$^2$ or less and said color developer contains from $3.5 \times 10^{-2}$ to $1.5 \times 10^{-1}$ mol/l of chloride ions and from $5.0 \times 10^{-5}$ to $5.0 \times 10^{-4}$ mol/l of bromide ion.

2. A method as claimed in claim 1, wherein said developer has a chloride ion content of from $4 \times 10^{-2}$ to $1 \times 10^{-1}$ mol/l.

3. A method as claimed in claim 1, wherein said color developing includes replenishing said color developer at a rate of 20 to 150 ml of color developer per m$^2$ of said silver halide color photographic material.

4. A method as claimed in claim 1, wherein the red-sensitive silver halide emulsion layer contains not more than 0.2 mol% silver iodide.

5. A method as claimed in claim 1, wherein the silver halide emulsion is a monodispersed emulsion having a coefficient of variation of grain size of not more than 20%.

6. A method as claimed in claim 1, wherein said color developer contains an organic preservative.

7. A method as claimed in claim 6, wherein the organic preservative is selected from a hydroxylamine derivative and a hydrazine derivative.

8. A method as claimed in claim 1, wherein the red-sensitive silver halide emulsion layer contains 0.5 to 2 mol% silver bromide.

9. The method of claim 1, wherein the total silver coverage of the photographic material is 0.75 g/m$^2$ or less.

* * * * *